US008086124B2

(12) United States Patent
Zaima

(10) Patent No.: US 8,086,124 B2
(45) Date of Patent: Dec. 27, 2011

(54) IMAGE FORMING APPARATUS

(75) Inventor: Nobuhiko Zaima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 931 days.

(21) Appl. No.: 11/565,148

(22) Filed: Nov. 30, 2006

(65) Prior Publication Data

US 2007/0127940 A1 Jun. 7, 2007

(30) Foreign Application Priority Data

Dec. 6, 2005 (JP) ..... 2005-352617

(51) Int. Cl.
*G03G 15/08* (2006.01)

(52) U.S. Cl. ..... 399/53; 399/54; 399/55; 399/341; 399/342; 430/124.13

(58) Field of Classification Search ..... 399/49, 399/53–55, 39, 341, 342; 430/124.13
See application file for complete search history.

(56) References Cited

U.S. PATENT DOCUMENTS 5,234,783 A * 8/1993 Ng ..... 430/45.53
5,260,753 A * 11/1993 Haneda et al. ..... 399/54
5,751,432 A * 5/1998 Gwaltney ..... 358/296
5,915,144 A 6/1999 Ide et al.
6,819,886 B2 * 11/2004 Runkowske et al. ..... 399/38
7,222,952 B2 * 5/2007 Uejima ..... 347/100
7,340,208 B2 * 3/2008 Ng ..... 399/329
7,542,707 B2 * 6/2009 Omata ..... 399/302
7,791,763 B2 * 9/2010 Takahashi et al. ..... 358/1.9
2003/0007814 A1 * 1/2003 Richards ..... 399/341
2003/0017310 A1 * 1/2003 Young ..... 428/195
2004/0021885 A1 * 2/2004 Nishikawa ..... 358/1.9
2005/0128524 A1 * 6/2005 Liu et al. ..... 358/3.06
2005/0135823 A1 * 6/2005 Ng ..... 399/49
2005/0135851 A1 * 6/2005 Ng et al. ..... 399/341
2005/0214006 A1 * 9/2005 Bessho ..... 399/49
2005/0243341 A1 * 11/2005 Ng ..... 358/1.9
2006/0127117 A1 * 6/2006 Eschbach et al. ..... 399/67
2006/0133870 A1 * 6/2006 Ng et al. ..... 399/341
2007/0268341 A1 * 11/2007 Morgan et al. ..... 347/74

(Continued)

FOREIGN PATENT DOCUMENTS

CN 1673885 A 9/2005

(Continued)

OTHER PUBLICATIONS

English translation of Suzuki (JP pub 2004070010 A), published Apr. 3, 2004.*

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus including toner image forming means for forming a having chromatic toner image a transparent toner image; fixing means for heating and fixing the non-transparent toner image and the transparent toner image on recording material; glossiness detecting means for detecting a glossiness of an area in which the non-transparent toner image and the transparent toner image are overlaid and fixed; control means for controlling an amount of the transparent toner, per unit area, on the recording material on the basis of a result of detection by the detecting means.

7 Claims, 24 Drawing Sheets

U.S. PATENT DOCUMENTS

| | | | | |
|---|---|---|---|---|
| 2009/0169277 | A1 * | 7/2009 | Fowlkes et al. | 399/341 |
| 2010/0196023 | A1 * | 8/2010 | Shiozawa | 399/39 |
| 2011/0038655 | A1 * | 2/2011 | Ng et al. | 399/341 |
| 2011/0039202 | A1 * | 2/2011 | Ng et al. | 430/124.1 |
| 2011/0206401 | A1 * | 8/2011 | Sone et al. | 399/67 |
| 2011/0236045 | A1 * | 9/2011 | Tanaka | 399/45 |

FOREIGN PATENT DOCUMENTS

| | | | |
|---|---|---|---|
| EP | 1 580 615 | A2 | 9/2005 |
| JP | 6-222646 | | 8/1994 |
| JP | 9-200551 | | 7/1997 |
| JP | 2004-070010 | | 3/2004 |
| JP | 2004070010 | A * | 3/2004 |

OTHER PUBLICATIONS

Office Action, dated May 30, 2008, issued in Chinese counterpart Patent Application No. 200610164136.1 and English-language translation thereof.

* cited by examiner (a)

(b)

IMAGE FORMING APPARATUS

FIELD OF THE INVENTION AND RELATED ART

The present invention relates to an image forming apparatus, such as an electrophotographic copying machine, printer, etc. In particular, it relates to a color image forming apparatus which forms a toner image on recording medium using a combination of color toner and transparent toner, and thermally fixes the toner image to the recording medium.

Generally, the glossiness level at which an electrophotographic image forming apparatus, such as the abovementioned one, in accordance with the prior art, forms an image is determined by the total amount of toner (color toner and transparent toner) deposited on a recording medium. Therefore, in order to control the glossiness level (after thermal fixation) at which the image forming apparatus forms an image, the amount by which transparent toner is deposited on a recording medium, per unit area, is controlled according to the total amount by which the color toners are deposited on the recording medium (Japanese Laid-open Patent Application 9-200551).

However, an image forming apparatus, such as the above described one, which heats the toner on recording medium to fix the toner to the recording medium suffers from the following problem. That is, the manner in which transparent toner melts as it is heated for fixation is affected by the recording medium type and the amount of color toner on the recording medium. Thus, it has been virtually impossible to form an image, the glossiness of which on recording medium is exactly at a desired level after the recording medium is heated for the fixation.

SUMMARY OF THE INVENTION

The primary object of the present invention is to provide an image forming apparatus capable of outputting an image, the glossiness of which is exactly at a desired level.

According to an aspect of the present invention, there is provided an image forming apparatus comprising toner image forming means for forming a having chromatic toner image a transparent toner image; fixing means for heating and fixing the non-transparent toner image and the transparent toner image on recording material; glossiness detecting means for detecting a glossiness of an area in which the non-transparent toner image and the transparent toner image are overlaid and fixed; control means for controlling an amount of the transparent toner, per unit area, on the recording material on the basis of a result of detection by said detecting means.

According to another aspect of the present invention, there is provided an image forming apparatus comprising toner image forming means for forming a non-transparent toner image and the transparent toner image on a recording material; fixing means for heating and fixing the non-transparent toner image and the transparent toner image on recording material; non-transparent toner image detecting means for detecting the non-transparent toner image fixed on the recording material by said fixing means; non-transparent toner amount control means for controlling a non-transparent toner amount, per unit area, on the recording material on the basis of a result of detection by said non-transparent toner image detecting means; glossiness detecting means for detecting a glossiness of an area in which the toner amount is controlled by said non-transparent toner amount control means and in which the non-transparent toner image and the transparent toner image are overlaid and fixed; transparent toner amount control means for controlling a toner amount, per unit area, of the transparent toner on the recording material on the basis of a result of detection by said glossiness detecting means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

The image processing apparatus 1001 in the first embodiment of the present invention will be described in detail, with reference to the appended drawings.

Embodiment 1

[Structure]

Figure 1:
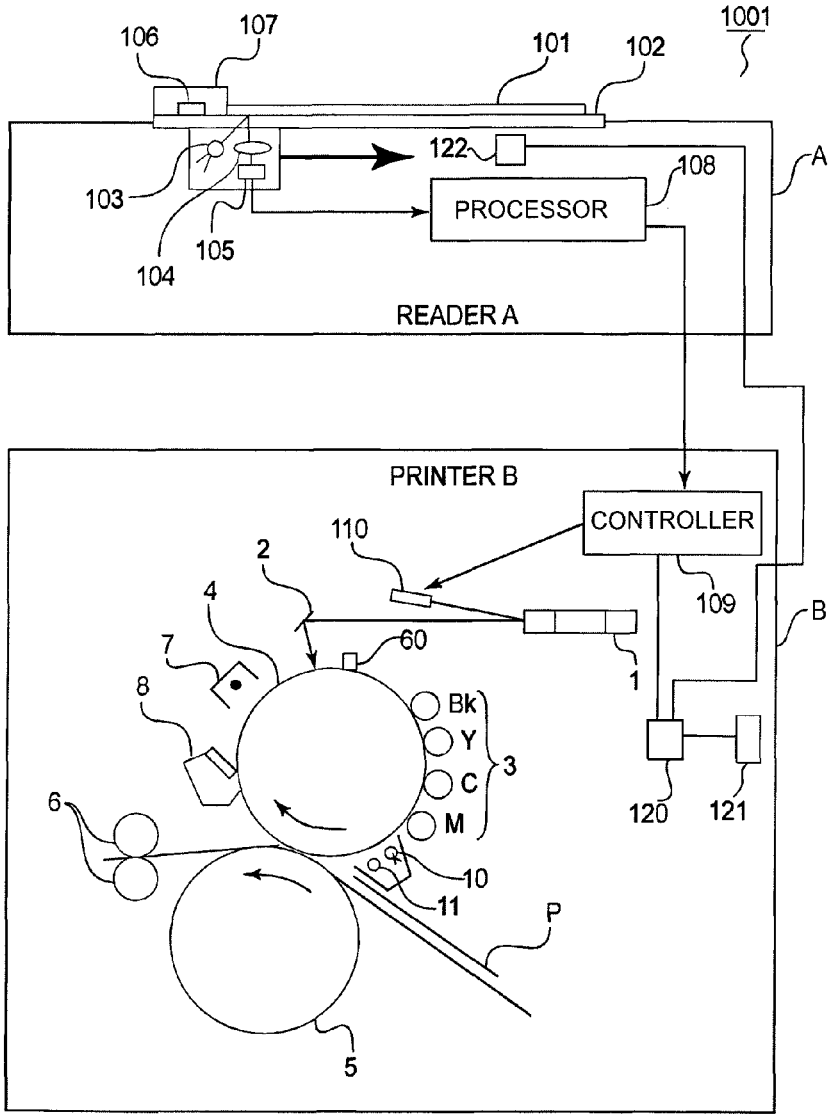
FIG. 1 is a schematic drawing of an image forming apparatus in the first embodiment of the present invention, showing the general structure thereof.

FIG. 1 is a schematic drawing of the image processing apparatus 1001, showing the general structure of the apparatus 1001.

[Reader Section]

An original 101 is placed on an original placement glass platen 102 of a reader section A, and is illuminated by a light source 103. The light reflected by the original 101 is focused on a CCD image sensor 105 (color image detecting means) through an optical system 104. The CCD image sensor 105 is made up of three groups of CCDs, which are the group for red color, group for green color, and group for blue color, in which the CCDs are arranged in a straight line. The CCD groups for the red, green, and blue colors generate picture signals corresponding to the primary color components of the original. The optical reading unit converts the optical image of the original 101 into sequential electrical signals, as it is moved in the direction indicated by an arrow mark in FIG. 1.

The optical reading unit is provided with an original positioning member 107 and a referential white color plate 106, which are disposed on the original placement glass platen 102. The original positioning member 107 is a member with which one of the edges of the original 101 is to be placed in contact to prevent the original 104 from being positioned askew on the original placement glass platen 102. The referential white plate 106 is used as the reference for properly setting the while level of the CCD image sensor 105, and also, for adjusting the shading of the CCD image sensor 105 in terms of the thrust direction.

The picture signals obtained by the CCD image sensor are processed by the image processing section 108 of the reader section A, and are sent to printing section B, in which the picture signals are processed by a printer controlling section 109.

Figure 2:
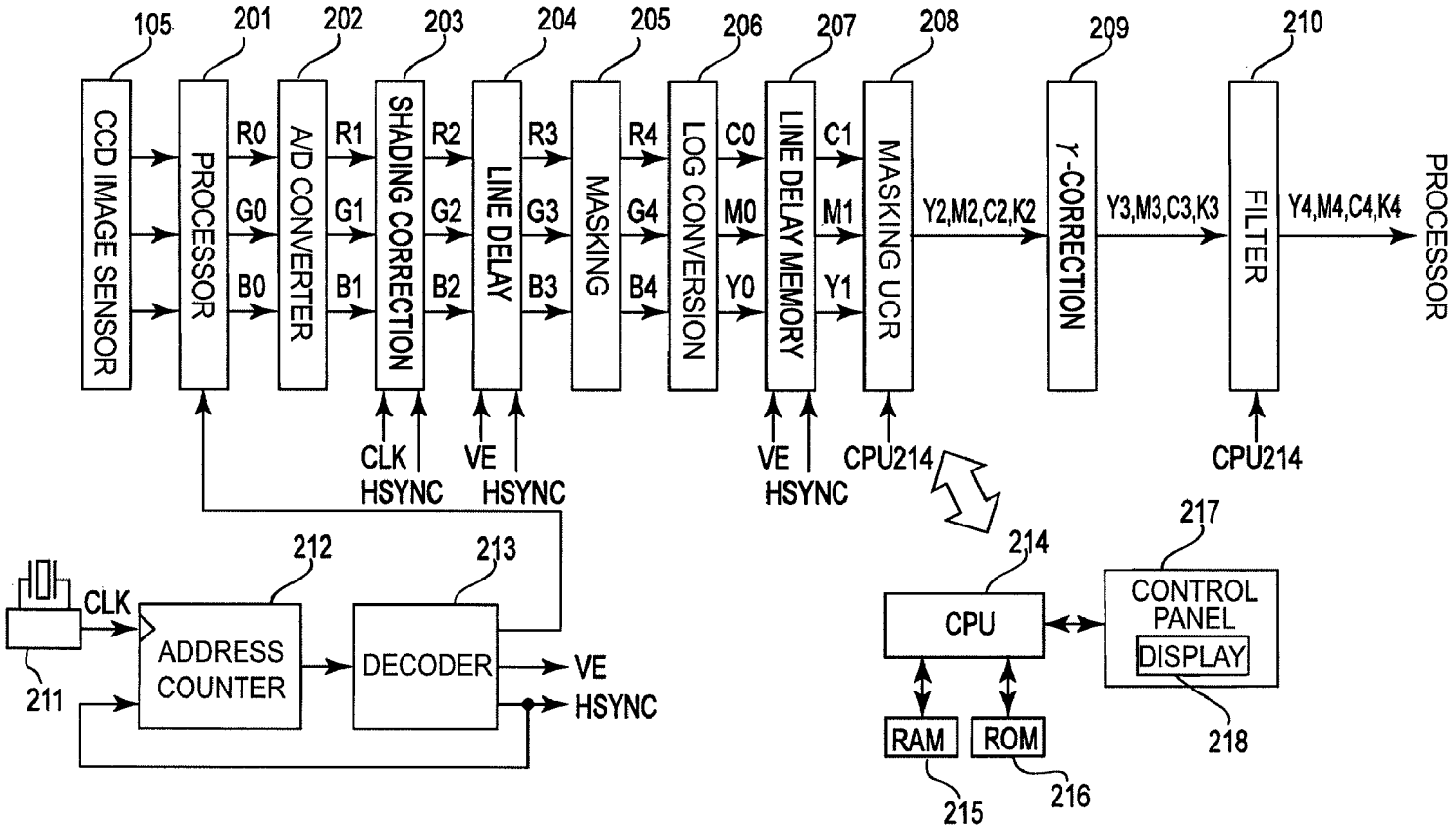
FIG. 2 is a block diagram of the reader section of the image processing apparatus, showing the picture signal flow.

FIG. 2 is a block diagram of the image processing section 108 of the reader section A, showing the flow of the image signals.

As shown in FIG. 2, the image signals outputted from the CCD image sensor 105 are inputted into the analog signal processing circuit 201, in which they are adjusted in gain and offset. Then, they are converted into digital eight-bit picture signals R1, G1, and B1 by an A/D converter 202. The picture signals R1, G1, and B1 are inputted into a shading correction circuit 203, in which they are corrected in shading, with reference to the signals obtained by reading the referential white plate 106, using one of the well-known methods.

A clock generation section 211 generates a clock signal CLK per picture element. An address counter 211 generates a primary scan address signal per line by counting clock signals CLK, and outputs the primary scan address signal. A decoder 213 generates CCD drive signals, VE signals, and line synchronization signals HSYNC, per line. The CCD drive signals are signals such as a shift pulse, a reset pulse, etc. The VE signal indicates the effective range for each line, in the picture signal sequence, which the CCD image sensor 105 outputs by reading the original 101. Incidentally, the address counter 212 is cleared by the line synchronization signal HSYNC, and then, begins counting the primary scan address signals for the next line.

The line sensors of the CCD image sensor 105 are aligned in the secondary scan direction with preset intervals. Therefore, the spatial deviation in terms of the secondary scan direction is corrected by a line delay section 204. More specifically, the line delay section 204 delays the R and G signals relative to the B signal, by lengths of time equivalent to the abovementioned preset intervals among the line sensors, in order to align the RGB signal in terms of spatial position.

An input masking circuit 205 converts the color space (space of read color) of each of the inputted picture signals, which is determined by the color separation characteristic of the RGB filters of the CCD image sensor 105, into preset color spaces (standard color space, for example, sRGB, NTSC, etc.), using the following matrix:

$$\begin{bmatrix} R4 \\ G4 \\ B4 \end{bmatrix} = \begin{bmatrix} a11 & a12 & a13 \\ a21 & a22 & a23 \\ a31 & a32 & a33 \end{bmatrix} \begin{bmatrix} R3 \\ G3 \\ B3 \end{bmatrix} \quad (1)$$

A LOG conversion circuit 206 is made up of ROMs containing look-up tables, and converts the luminance signals R4, G4, and B4 into density signals C0, M0, and Y0. A line delay memory 207 delays the density signals C0, M0, and Y0 by a length of time equal to the length of time necessary for criterion signals, such as UCR, FILTER, SEN, etc., to be generated and outputted by an unshown black character decision section.

A masking UCR circuit 208 extracts black signals from the three primary color signals Y1, M1, and C1 inputted into the masking UCR circuit 208. It also carries out the computation for adjusting the printer section B, in the turbidity of colorants, and sequentially outputs picture signals Y2, M2, C2, or Bks for every reading operation, with a preset bit width (eight bit, for example). A gamma correction circuit 209 corrects picture signals in terms of density, in order to adjust the printer section B to achieve the ideal gradation. An output filter 210 processes the picture signals to form an image, in which various borders between adjacent areas are sharp and/or smooth.

Picture signals M4, C4, Y4, and Bk4 produced in the listed order through the above described processes are sent to the printer controlling section 109, in which they are turned into pulse signals by pulse width modulation. Then, the pulse signals are used by the printer section B to carry out density recording.

A CPU 214 uses a RAM 215 as a work memory to control the reader section A, and also, to process picture signals, according to the programs stored in a RAM 216. An operator is to input operational instructions and processing conditions into the CPU 214 through a control panel 217. A monitor 218 displays the state of the image processing apparatus, processing conditions set automatically or manually by the operator, etc.

Figure 3:
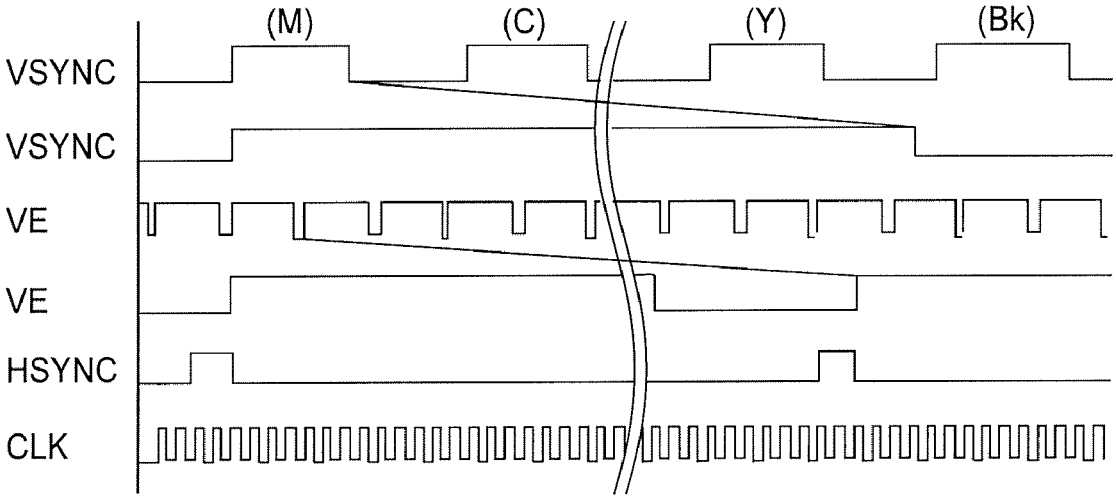
FIG. 3 is a timing chart showing the timing with which various signals are turned on or off in the reader section of the image processing apparatus.

FIG. 3 is a timing chart for the image processing section 108, showing the on-and-off timings of various signals.

In FIG. 3, a referential acronym VSYNC stands for a signal which indicates an effective image range in terms of the secondary scan direction. While VSYNC is at logic "1", the original 101 is read (scanned), and C, M, Y, and Bk signals are sequentially generated and outputted. An acronym VE stands for a signal which indicates the effective image range in terms of the primary scan direction. While the signal VE is at logic "1", the primary scan start position is set. The signal VE is primarily used for counting lines to control line delay. An acronym CLK stands for a picture element synchronization signal. Picture data are transferred in synchronization with the signal startup from "0" to "1".

(Printer Section)

In the printer section (toner image forming means) B, shown in FIG. 1, which forms a toner image, the peripheral surface of a photosensitive drum 4 is uniformly charged by a primary charger 7. The printer controlling section 109 outputs pulse signals in accordance with the picture data inputted by a laser driver. A laser light source 110 outputs a beam of laser light while modulating it with inputted pulse signals. The outputted beam of laser light is reflected by a polygon mirror 1 and a mirror 2, scanning thereby the peripheral surface of the charged photosensitive drum 4. As a result, an electrostatic latent image is formed on the peripheral surface of the photosensitive drum 4.

The electrostatic latent image formed on the peripheral surface of the photosensitive drum 4 is developed by a developing device 3; four electrostatic latent images are formed per full-color image, and are developed by four developing devices 3 and toners therein, which are different in color. In this embodiment, two-component toners are used for the development. The four developing devices 3 for developing black Bk, yellow Y, cyan C, and magenta M colors, one for one, are in the adjacencies of the peripheral surface of the photosensitive drum 4, listing from the upstream side in terms of the rotation of the photosensitive drum 4. When a latent image corresponding to one of the four colors is developed, the developing device corresponding to this color is placed virtually in contact with the peripheral surface of the photosensitive drum 4 to develop the latent image.

A recording medium P is wrapped around a transfer drum 5, which rotates one full turn for each of the four primary colors, rotating therefore a total of four full turns per full-color image. In other words, the recording medium P is moved between the peripheral surfaces of the photosensitive drum 4 and transfer drum 5 four times per full-color image. While the recording medium P is moved between the peripheral surfaces of the photosensitive drum 4 and transfer drum 5, the four toner images different in color are transferred in layers onto the recording medium P. After the image transfer, the recording medium P is separated from the transfer drum 5, and is sent to a pair of fixation rollers 6 (fixing means), by which toner (toner images) on the recording medium P is fixed, yielding a full-color print (copy).

Disposed also in the adjacencies of the peripheral surface of the photosensitive drum 4 are a sensor 60 for measuring the surface potential level of the photosensitive drum 4, and a cleaner 8 for removing the toner particles remaining on the peripheral surface of the photosensitive drum 4 (toner particles which were not transferred). In terms of the rotational direction of the photosensitive drum 4, the sensor 60 and cleaner 8 are on the upstream side of the developing devices 3. Further, the combination of an LED 10 and a photo-diode, which is for detecting the amount of the light reflected by the toner patch formed on the peripheral surface of the photosensitive drum 4, is disposed in the adjacencies of the peripheral surface of the photosensitive drum 4.

Figure 4:
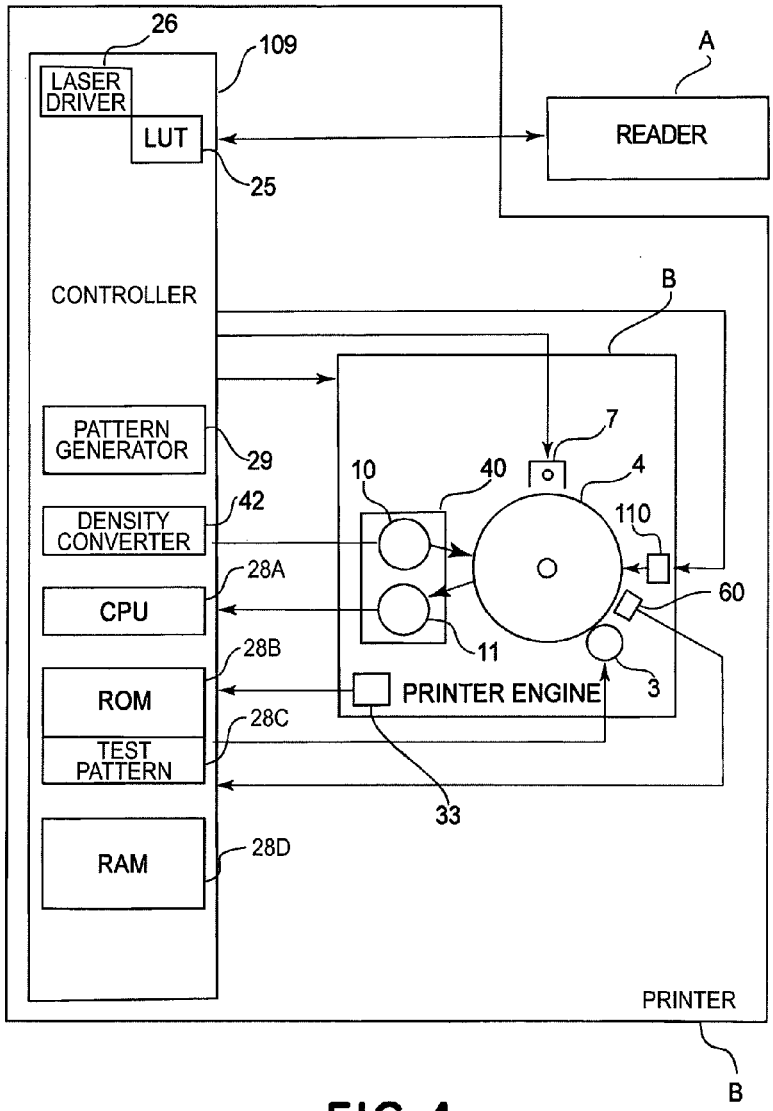
FIG. 4 is a block diagram of the printer section, showing the general structure thereof.

FIG. 4 is a block diagram of the printer section B, showing the general structure thereof.

The printer control section 109 is made up of a CPU 28A, a ROM 28B, a RAM 28D, a test pattern storage section 28C, a density conversion circuit 42, a LUT 25, a laser driver 26, etc. It is enabled to communicate with the reader section A and printer section B. The CPU 28 controls the operation of the printer section B, and also, controls the grid potential of the primary charger 7 and the development bias of the developing device 3.

The printer section B is made up of the photosensitive drum 4, and the components disposed in the adjacencies thereof, that is, the photosensor 40 made up of the LED 10 and photo-diode 11, primary charging device 7, laser light source 110, surface potential sensor 60, developing device 3, etc. The printer section B is also provided with an ambience sensor 33 which measures the amount of moisture in the air (or temperature and humidity) in the apparatus.

(Structure of Image Processing Apparatus)

Figure 5:
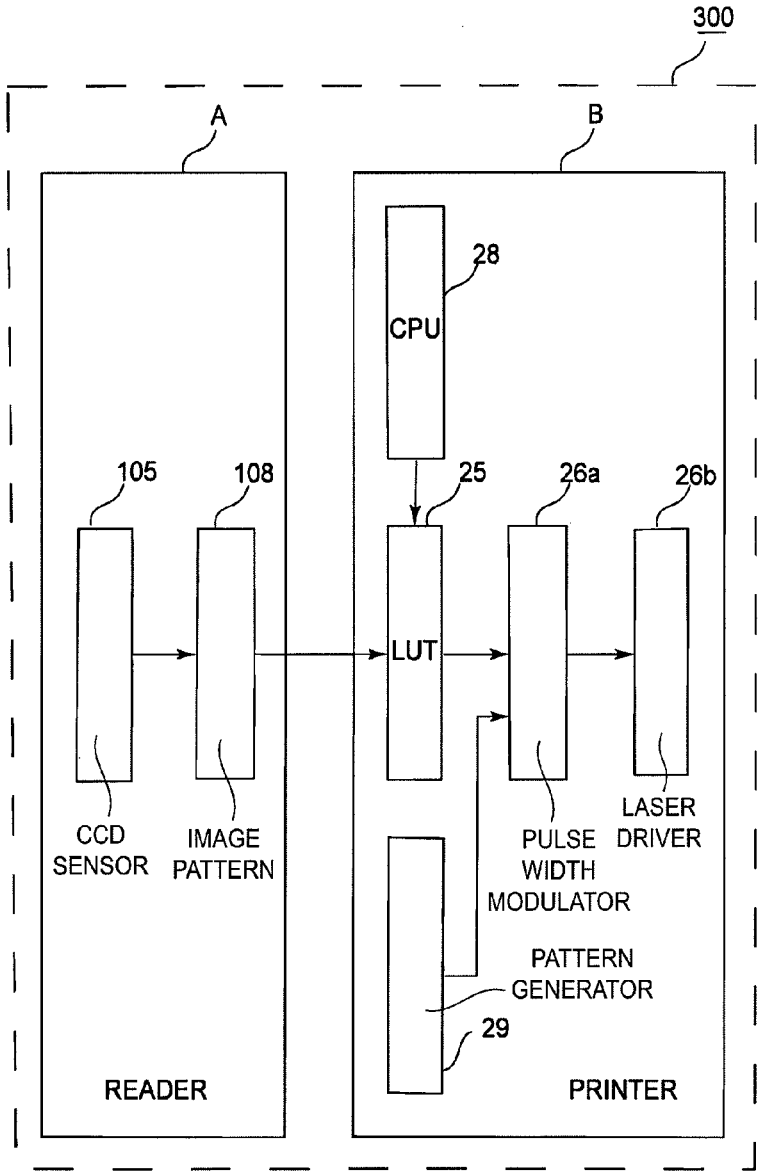
FIG. 5 is a block diagram of the image processing apparatus for obtaining a gradation-based image, showing the structure thereof.

FIG. 5 is a block diagram of the image processing apparatus 300 (color toner amount controlling means) for forming a gradation-based image, showing the general structure thereof.

The luminance signals for images, which are outputted by the CCD image sensor 105, are sequentially converted by the image processing apparatus 108 of the reader section A into density signals. The resultant density signals are corrected by the LUT 25 (γLUT) in γ characteristic so that they match the gamma characteristic of the printer section, immediately after the printer portion initialization, that is, so that the original and the image outputted by the printer section match in density.

Figure 6:
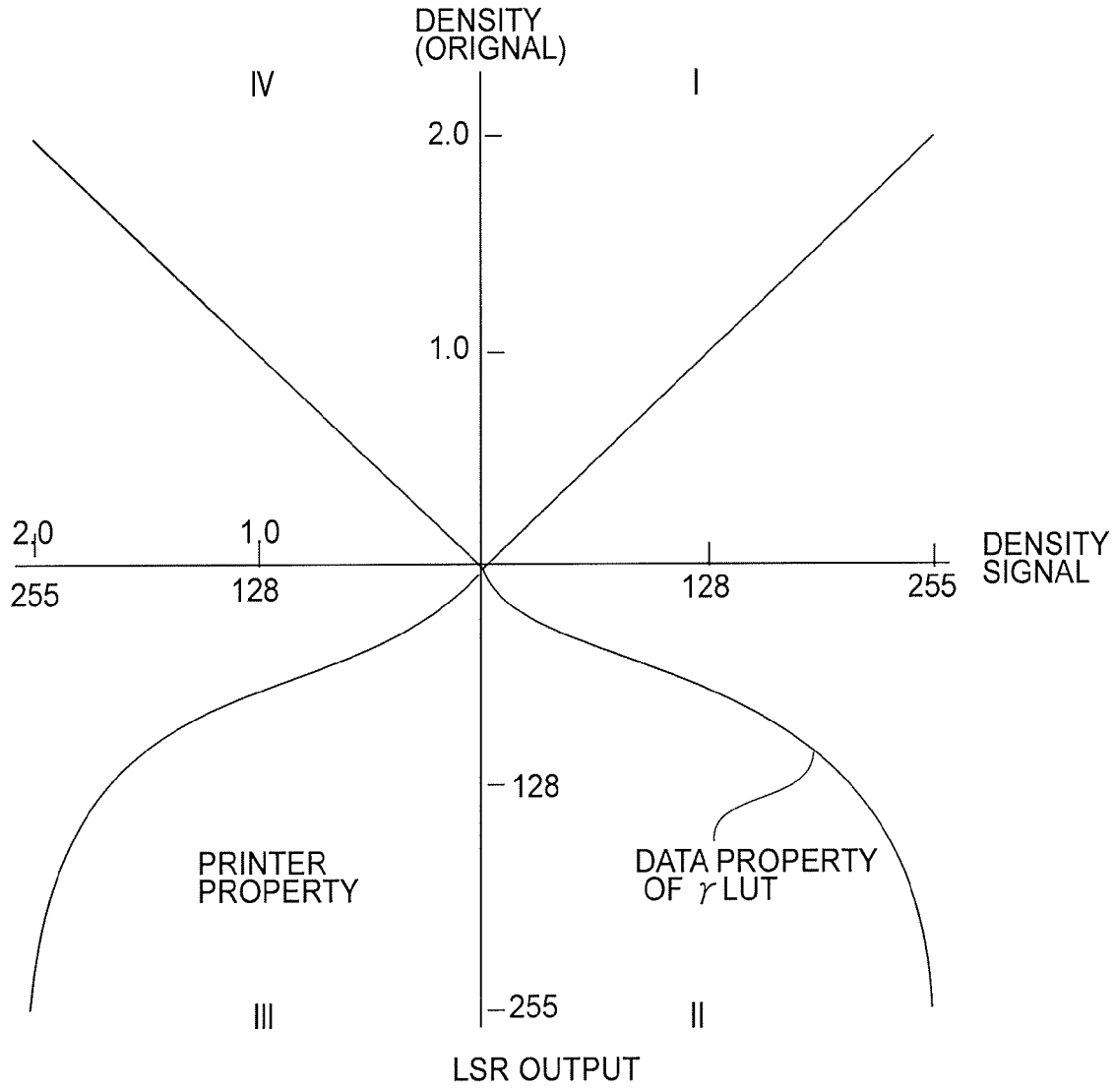
FIG. 6 is a quadruple graph showing how the tonal gradation of an original is reproduced.

FIG. 6 is a four-quadrant chart which shows the process through which an image, the gradation of which matches that of the original is reproduced. The first quadrant shows the characteristic of the reader section A which converts the original 101 into density signals, and the second quadrant shows the characteristic of the LUT 25 which converts the density signals into laser output control signals. The third quadrant shows the characteristic of the printer section B which converts the laser output control signals into the density gradation with which an image is outputted, and the fourth quadrant shows the relationship between the density of the original and the density of the outputted image. In other words, FIG. 6 shows the overall characteristic, that is, density gradation reproduction characteristic, of the image processing apparatus, shown in FIG. 1. Incidentally, in this embodiment, since picture signals outputted from the CCD image sensor are digital eight-bit signals, 256 levels of density gradation can be reproduced.

In order to make the image processing apparatus linear in overall density gradation characteristic, that is, in order to make linear the relationship between the density of the original and the density with which an image is outputted, shown in the fourth quadrant, the density signals are adjusted in characteristic by the LUT 25, as shown in the second quadrant, to compensate for the characteristic of the printer section B, which is shown in the third quadrant. After the picture signals are adjusted in gradational attribute, they are converted by the pulse width modulation (PWM) circuit 26*a* of the laser driver 26 into pulse signals, the width of which corresponds to dot width. Then, the pulse signals are sent to a laser driver 26*b* of the laser light source 110, which turns on or off the laser light source 110. Incidentally, in this embodiment, the gradations for all the colors Y, M, C, and Bk are reproduced using pulse modulation.

The peripheral surface of the photosensitive drum 4 is scanned by the beam of laser light outputted from the laser light source 110. As a result, an electrostatic latent image, the gradation of which matches the preset gradational characteristics is formed, on the peripheral surface of the photosensitive drum 4. The gradation level is controlled by changing the dot size. Through the above described processes of developing, transferring, and fixing, an image (copy of original), the gradation of which matches that of the original is formed (reproduced).

[First Control System]

Next, a first control system, which is related to the stabilization, in terms of the image reproduction characteristic, of the image formation system, inclusive of both the reader section A and printer section B, and which performs a control sequence different from the control sequence for the normal image forming operation for forming an image on recording paper, will be described. First, the control system for calibrating the printer section B with the use of the reader section A will be described.

Figure 7:
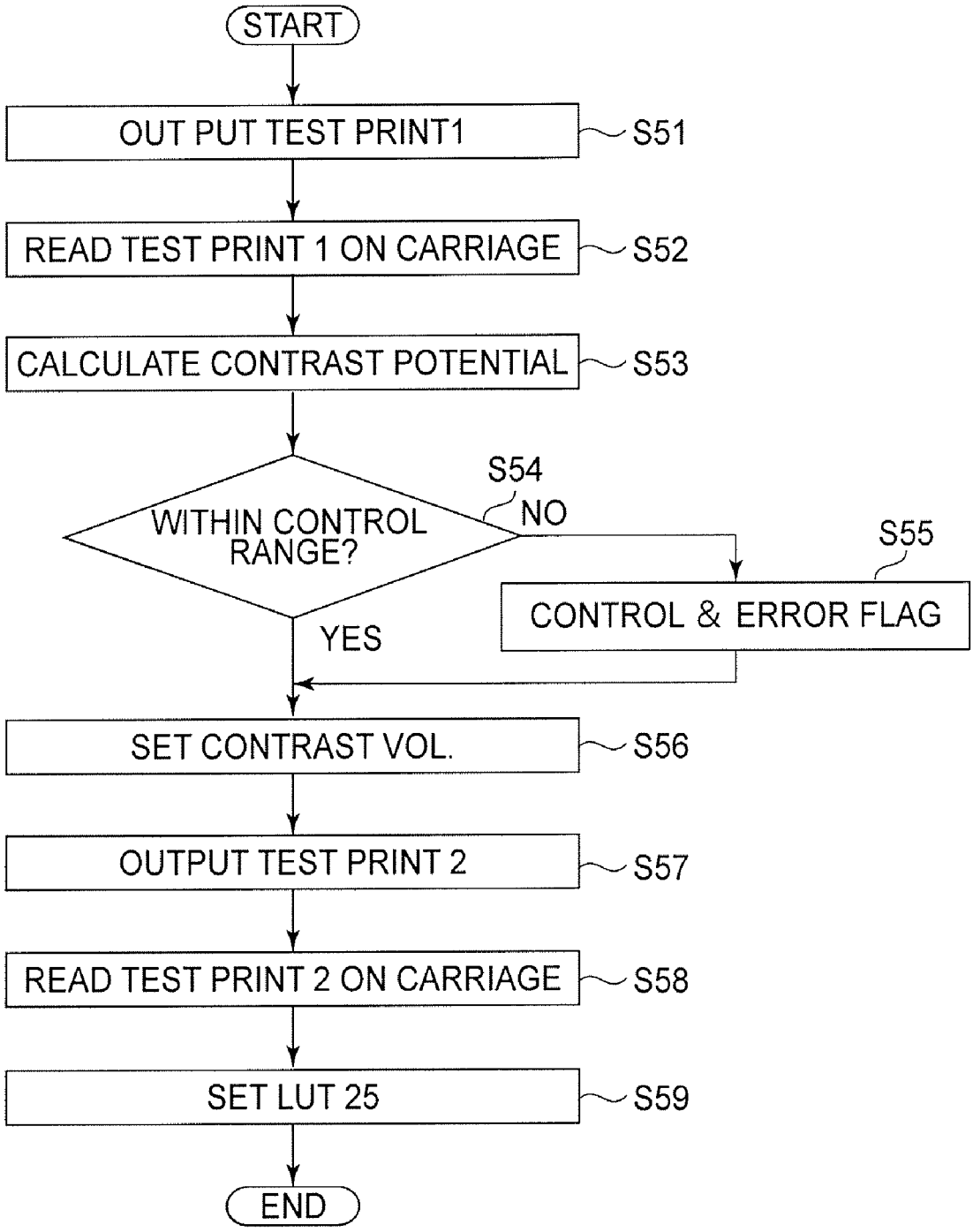
FIG. 7 is a flowchart of an example of a calibration sequence.

FIG. 7 is a flowchart of an example of the abovementioned calibration sequence. The printer section B is calibrated by the coordination between the CPU 214 which controls the reader section A and the CPU 28 which controls the printer section B.

As a mode selection button marked "automatic gradation correction", for example, with which the control panel 217 is provided, is pressed by an operator, the calibration sequence shown in FIG. 7 starts. Incidentally, referring to FIGS. 8-10, the monitor 218 is made up of a liquid crystal display panel provided with touch sensors (touch screen display).

Figure 8:
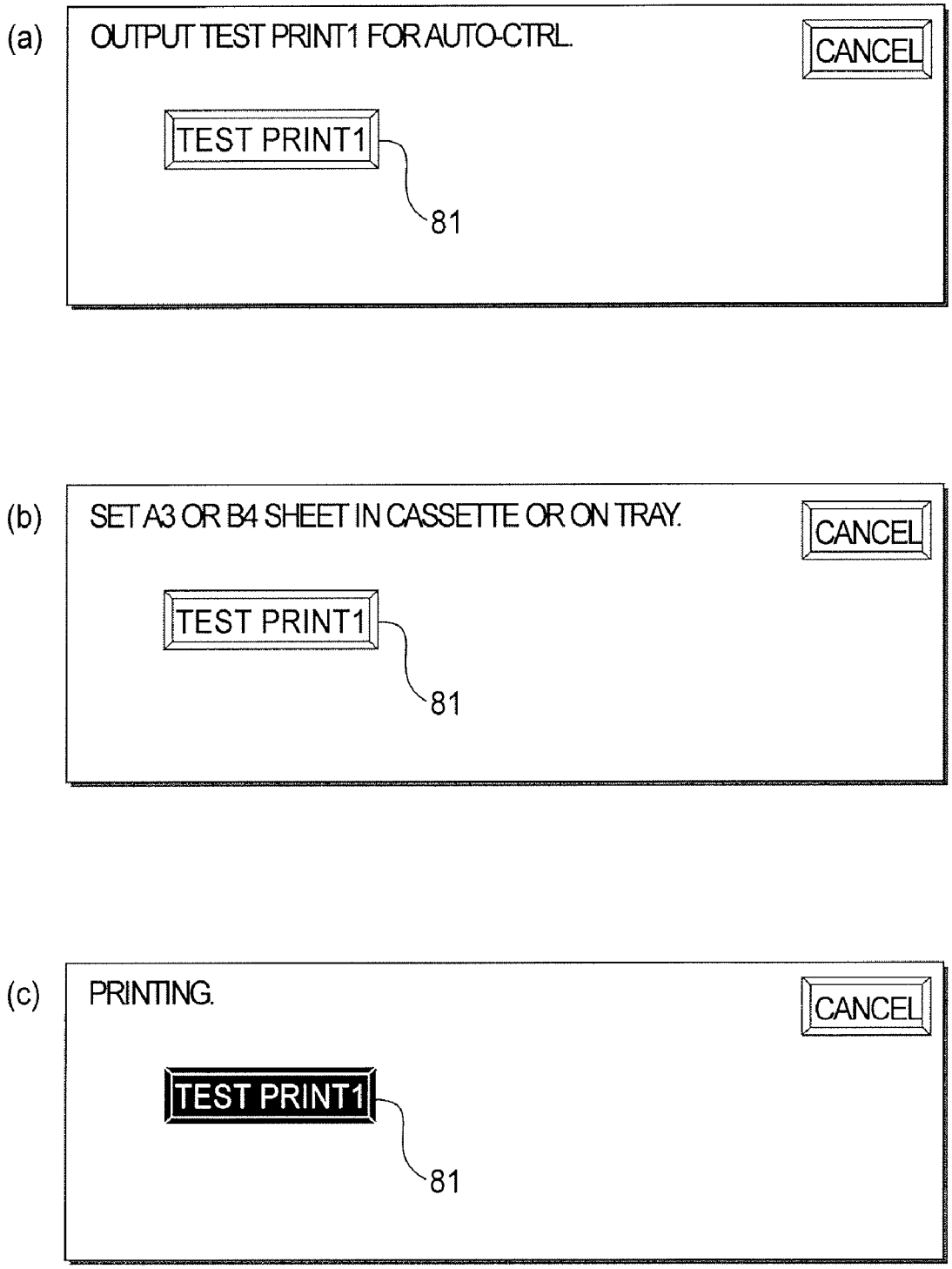
FIGS. 8(*a*), 8(*b*), and 8(*c*) are examples of the images displayed on the monitor screen.
Figure 11:
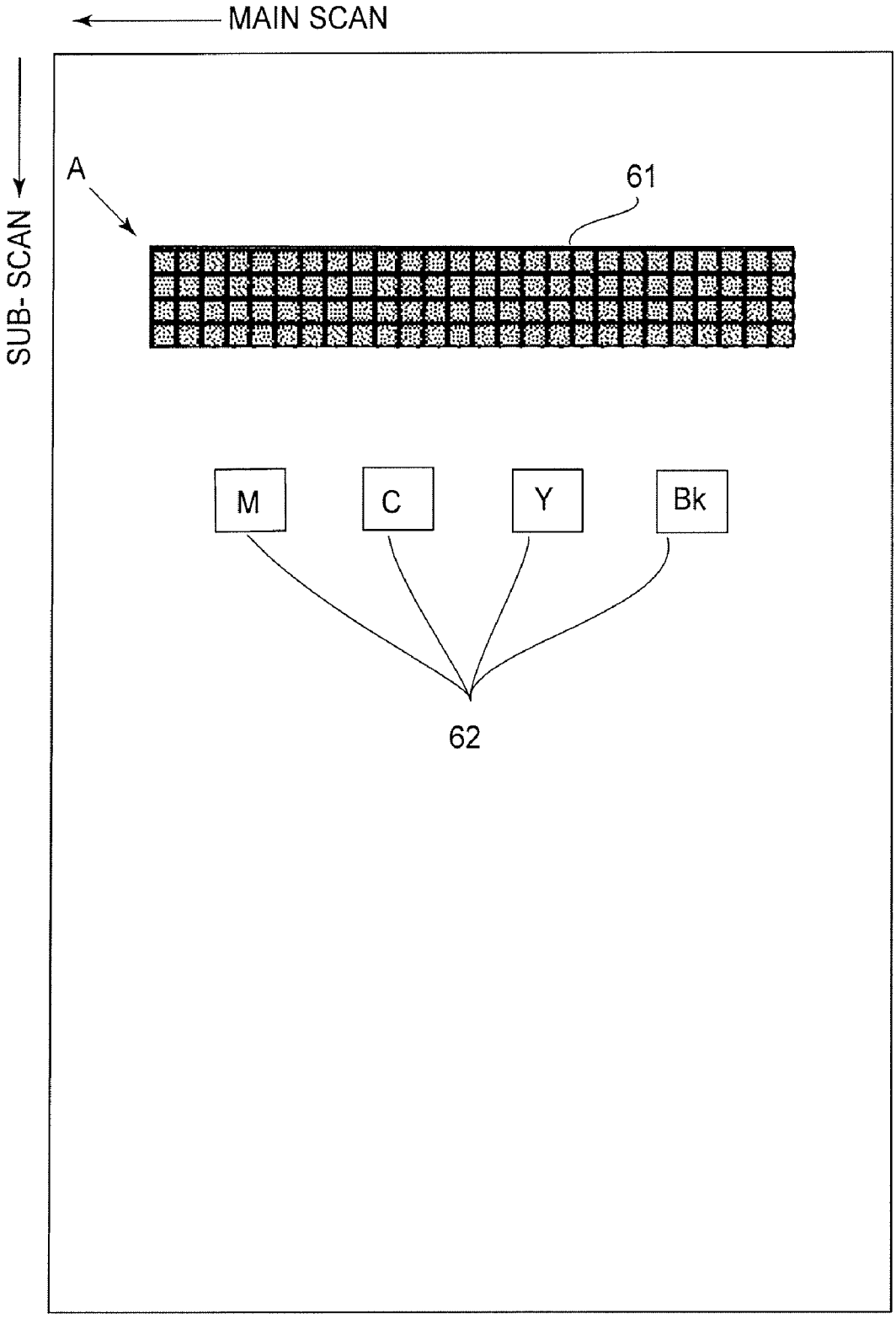
FIG. 11 is a test image 1.

First, a start button 81 for starting the printing of a test pattern (image) 1 shown in FIG. 8(*a*) appears on the monitor screen 218. As the operator presses the start button 81 showing "test pattern 1", the test pattern 1, shown in FIG. 11, is printed by the printer section B (S51). During this step, the monitor screen 218 displays the images shown in FIG. 8(*b*). Further, the CPU 214 checks whether or not recording medium such as a sheet of recording paper is available for the printing of the test pattern 1. If the CPU 214 determines that no recording medium is available, it displays a warning image, such as the one shown in FIG. 8(*b*), on the screen 218.

As the contrast potential for the image processing section 108, the optimal value for the ambience is registered as the initial value, and this value is used as the contrast potential value for printing the test pattern 1. Here, the contrast potential means the difference in potential level between the development bias, and an exposed point of a given area of the peripheral surface of the photosensitive drum 4, after the given area is charged (primary charge), and then, exposed to a beam of laser light emitted while being modulated with a signal (corresponding to the maximum value (255 in the case of eight-bit signal). The image processing apparatus is also provided with multiple recording paper cassettes, which contain B4, A3, A4, and B5 sheets of recording paper, one for one, offering thereby multiple choices in terms of recording medium size. However, the size of the sheet of recording paper used for this control sequence is limited to the so-called large size, that is, B4, A3, 11×17, or LGR, to prevent the mix-up in the positioning of the sheet of recording paper between "portrait" and "landscape", from occurring when placing the sheet of recording paper, on which the test pattern has been printed, on the original placement platen to read the printed test pattern.

Figure 12:
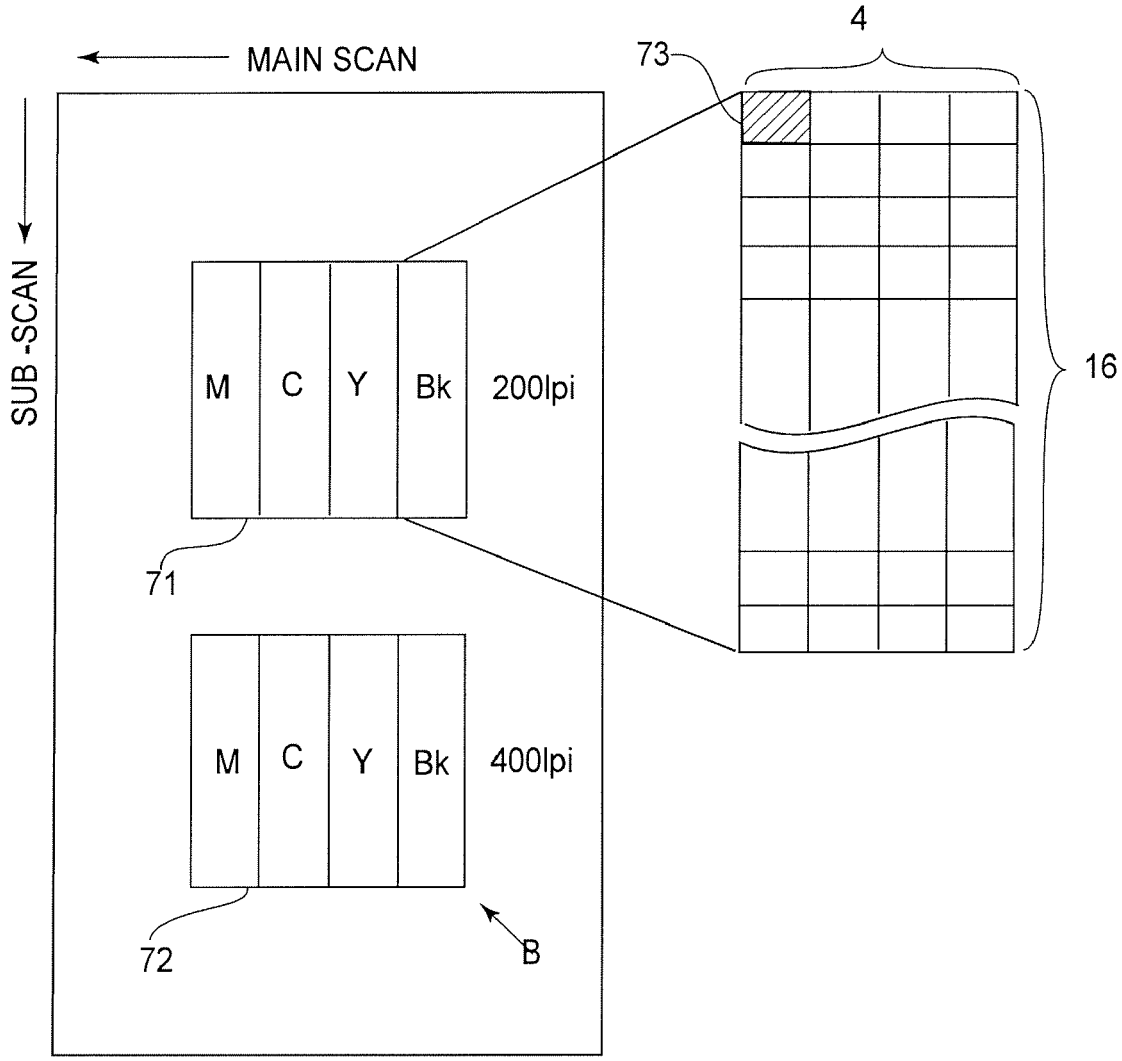
FIG. 12 is a test image 2.

The test pattern 1, shown in FIG. 11, includes a pattern 61 made up of multiple black halftone patches, and four color patches 62, that is, the Y, M, C, and Bk color patches. The pattern 61 is in the form of a long and narrow rectangle. The printed image of this pattern 61 is examined with the naked eye to check whether or not the printed pattern is abnormal or not, that is, it is streaky, nonuniform in density, deviated in color, or not. The size of a patch 62, and the sizes of the gradation patches 71 and 72 shown in FIG. 12, are set so that they fall within the reading range of the CCD image sensor 105 in terms of the thrust direction.

If anomaly is detected by the examination the printed test pattern with the naked eye, the test pattern 1 is to be printed again. If anomaly is detected again, a service personnel should be called to have a maintenance service performed on the apparatus. Incidentally, the image processing apparatus may be designed so that the printed image of the abovementioned rectangular pattern 61 is read by the reader section A to obtain the density information in terms of the thrust direction, and whether or not the following control sequence be carried out is automatically determined based on the density information provided by the reader section A.

The density of the patch 62 (Y, M, C, and Bk patches) corresponds to the maximum density of the Y, M, C, and Bk color, that is, the density signal value 255.

Figure 9:
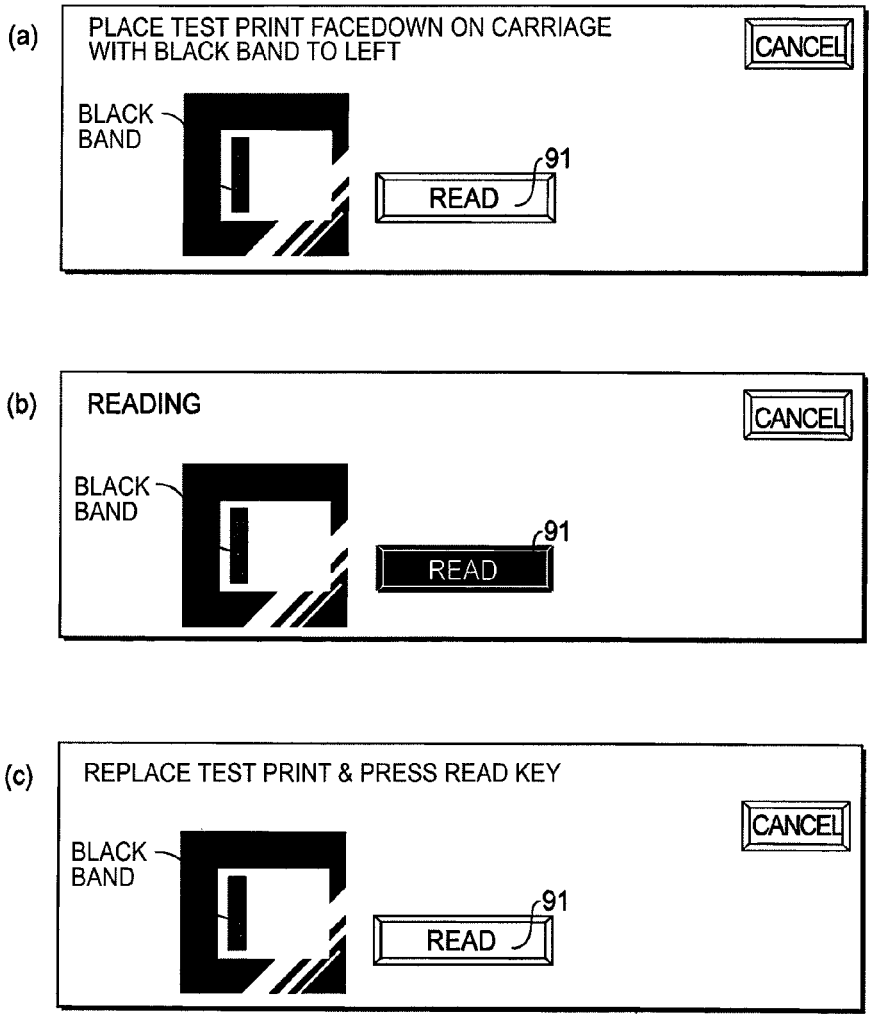
FIGS. 9(*a*), 9(*b*), and 9(*c*) are examples of the images displayed on the monitor screen.
Figure 13:
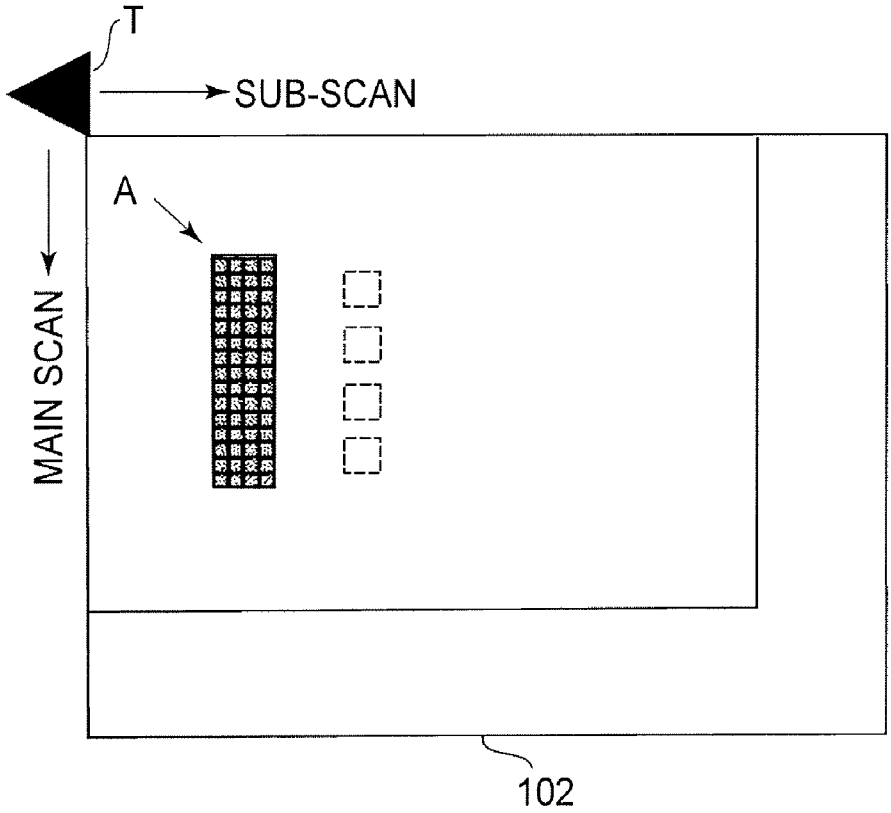
FIG. 13 is a schematic drawing showing how a copy of the test image 1 is placed on the original placement platen.

Next, the operator is to place the printed image of the test pattern 1 on the original placement glass platen 102 as shown in FIG. 13, and to press a "read" button 91, shown in FIG. 9(*a*). Before the operator presses the button 91, an operational instruction, such as the one shown in FIG. 9(*a*), is displayed across the monitor screen 218.

FIG. 13 is a top view of the original placement platen 102. The marking T, which is in the form of a wedge, is a referential marking for correctly positioning the original (copy of test pattern). The copy of the test pattern is to be placed on the platen 102 so that the rectangular test pattern 61 is on the referential mark T side. Further, attention must be paid so that the copy of the test pattern is not placed upside down. Across the monitor screen 218, a message as the operational guidance is displayed. The operational guidance is intended to prevent the problem that the erroneous placement of the copy of the test pattern 1 leads to erroneous control of the image processing apparatus.

The copy of the test pattern 1 is sequentially read (scanned), starting from the point in contact with the referential marking T. As the printed test pattern 1 is scanned, the first density gap point is obtained at the point which coincides with the corner (point A in FIG. 11) of the rectangular pattern 61. The coordinates of this density gap point A is used to calculate the relative positions of the patches 62, and the density of each patch 62 is read (S52). While the printed test pattern 1 is read, an image such as the one shown in FIG. 9(*b*) is displayed across the monitor screen 218. If the printed test pattern 1 cannot be read because of the errors in the orientation and/or position of the copy of test pattern 1, a message, such as the one shown in FIG. 9(*c*), is displayed across the monitor screen 218, in order to prompt the operator to correct the orientation and/or position of the copy of the test pattern 1 and press the "read" button 91 again so that the printed test pattern 1 is read again.

The RGB values obtained from the reading (scanning) of the patches 62 are converted into optical densities using the following equations. A letter k in the equation stands for a coefficient for correcting the optical densities obtained through the above described steps so that they match the values which will be obtained using a commercial densimeter. Further, the luminance information of the RGB may be converted into the density information of MCYBk, using a LUT which is specifically prepared for this conversion.

$$M=-km\times\log10(G/255)$$

$$C=-kc\times\log10(R/255)$$

$$Y=-ky\times\log10(B/255)$$

$$Bk=-kk\times\log10(G/255) \quad (2)$$

Figure 15:
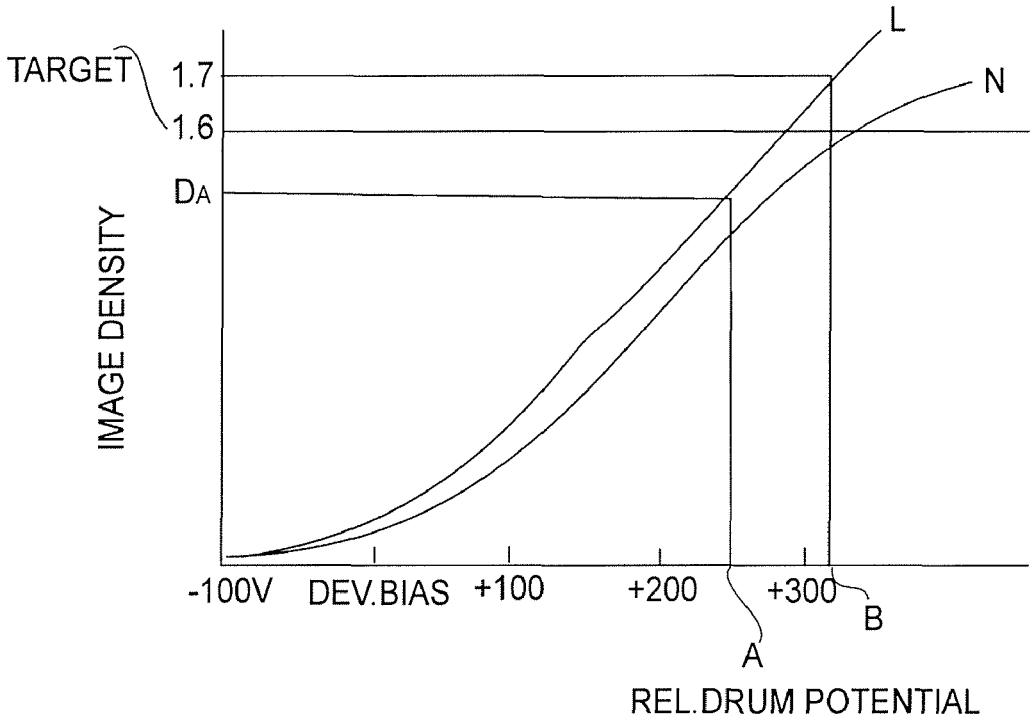
FIG. 15 is a graph showing the relationship between the relative potential level of the peripheral surface of the photosensitive drum, and the image density.

Next, the method for correcting the maximum density level, using the obtained density information, will be described. FIG. 15 is a graph showing the relationship between the relative surface potential level of the photosensitive drum 4 and the image density level computable using the above equations.

A letter "A" stands for the contrast potential (difference in potential level between development bias, and a point of peripheral surface of photosensitive drum 4, which was charged (primary charge), and then, was exposed to a beam of laser light, the intensity of which corresponded to the maximum signal value 255 (eight-bit signal)). A referential symbol "$D_A$" stands for the density of the area of the copy of the test pattern 1, which corresponds to the patches 62 of the test pattern 1.

Where the density is close to the maximum value, the relationship between the image density and relative surface potential level is practically linear as the solid line L in FIG. 15 shows. However, if the developer in the developing device 3 in the two-component development system reduces in toner content, the relationship between the image density and the relative drum surface potential level sometimes becomes nonlinear, across where the density is close to the maximum value, as a broken line N in FIG. 15 shows. Thus, in order to provide a margin of 0.1, the target value to be used for controlling the highest density level is set to 1.7, although the actual target value for the highest density is 1.6, as shown in FIG. 15. The contrast potential level B corresponding to the target value for the controlling the highest density level is obtained from the following equation:

$$B=(A+Ka)\times1.7/D_A \quad (3).$$

A term Ka in Equation (3) stands for a coefficient of correction. It is desired that an optimal value is selected according to the type of the selected developing method.

Figure 16:
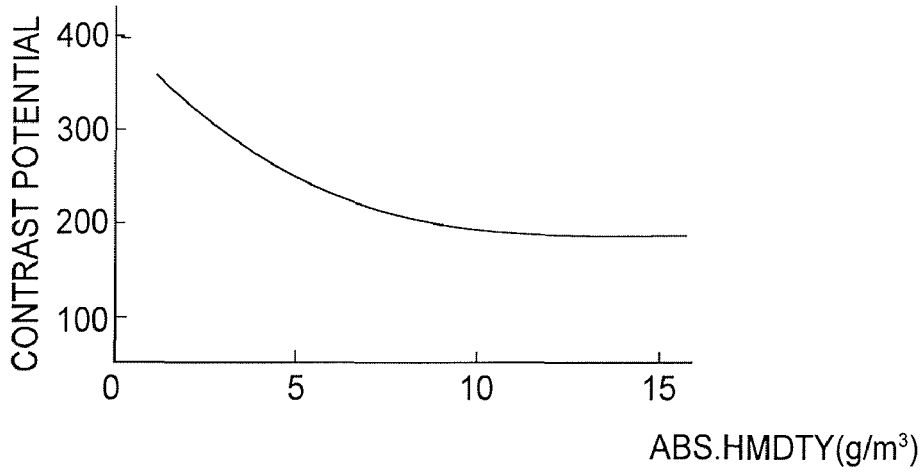
FIG. 16 is a graph showing the relationship between the absolute moisture content and the contrast potential.

The contrast potential for an electrophotographic image forming method must be set according to the ambience. Otherwise, the image density of a copy of an original does not match that of the original. Therefore, the contrast potential level for the highest density level is set, as shown in FIG. 16, according to the output (absolute amount of water content) of the ambience sensor 33, shown in FIG. 4, for monitoring the amount of the above described internal humidity of the apparatus.

Thus, in order to correct the contrast potential, the correction coefficient $V_{cont.ratel}$ obtainable from the following equation is stored in a RAM or the like, which is backed up.

$$V_{cont.ratel}=B/A$$

The image processing apparatus is set up so that it monitors the ambient humidity every 30 minutes. Then, it computes the optimal value for the contrast potential B each time the value of A is set, based on the detected ambient humidity.

Figure 17:
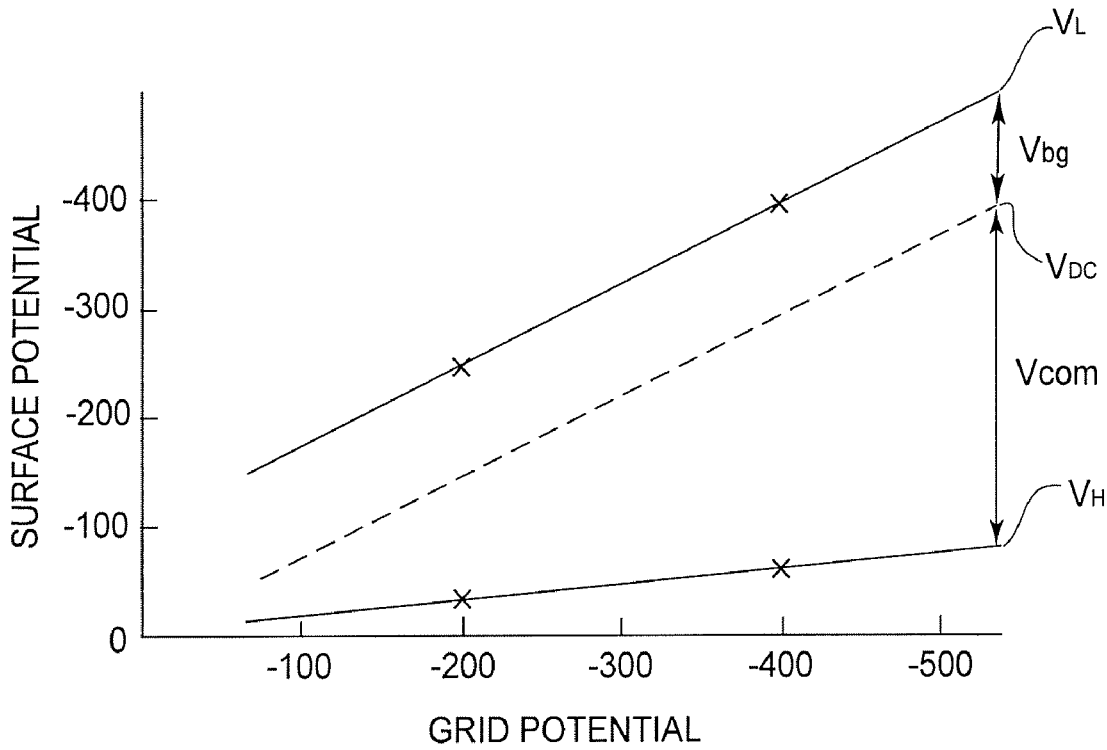
FIG. 17 is a graph showing the relationship between the grid potential and surface potential.

Next, the method for determining proper values for the grid potential and development bias, based on the contrast potential level, will be briefly described. FIG. 17 is a graph showing the relationship between the grid potential level and the surface potential level of the photosensitive drum 4. "Grid potential level" means the magnitude (voltage) of the potential applied to the electrode (grid) of a corona discharging device (used as the primary charging device 8. "Development bias potential level" means the magnitude (voltage) of the potential applied to the developing device 3.

With the grid potential set to −200 V, the surface potentials VL and VH of the photosensitive drum 4 are measured by a surface potential sensor 12. The surface potential VL is the potential level of a given point of the peripheral surface of the photosensitive drum 4 immediately after the given point was exposed to the beam of laser light when the intensity of the beam corresponded to the minimum signal value, whereas the surface potential VH is the potential level of a given point of the peripheral surface of the photosensitive drum 4 immediately after the given point was exposed to the beam of laser light when the intensity of the beam corresponded to the maximum signal value. Further, with the grid potential set to −400 V, the surface potentials VL and VH of the photosensitive drum 4 are measured by the surface potential sensor 12. Then, from the data obtained with the grid potential set to −200 V and the data obtained the grid potential set to −400 V, the relationship between the grid potential and surface potential is obtained using the processes of interpolation and external insertion. Incidentally, this control sequence for obtaining these data is called potential measurement control.

Next, a development bias Vdc is set so that a difference Vbg (100 V, for example) is provided between the surface potential VL and development bias Vdc to prevent the formation of a foggy image. The contrast potential Vcont is the difference between the development bias Vdc and surface potential VH of the photosensitive drum 4. Therefore, the greater the contrast potential Vcont, the higher the density, as described above.

The grid potential level and development potential level for achieving the contrast potential level B obtained through the above described calculation can be obtained from the relationship shown in FIG. 17. Therefore, the CPU 28 obtains the contrast potential value which makes the highest density level at which an image is formed will be 0.1 higher than the actual target density. Then, it sets the grid potential and development potential so that the difference in potential level between the two potentials matches this contrast potential value (S53).

Next, it is checked whether or not the value selected for the contrast potential is within the control range (S54). If the selected value is outside the control range, it is determined that the developing device(s) 3 and/or the like is in the abnormal condition, and an error flag is raised to check the developing device 3 for the corresponding color. The state of this error flag can be seen by a service personnel by placing the apparatus in a preset mode. Further, if it is determined that the developing device(s) 3 and/or the like is in the abnormal condition, the contrast potential is corrected, that is, it is set to the closest value in the control range from the selected value, and the control sequence is continued (S55).

The CPU 28 controls the grid potential and development bias so that the contrast potential value obtained through the above described process is achieved (S56).

In this embodiment, the grid potential for each of the developing devices for Y, M, C, and Bk colors, was set to −400 V, and the development bias potential was set to −280 V. Further, the above described control was carried out for each of Y, M, C, and Bk colors. That is, the grid potential and development bias potential for each color were independently set from those for the rest, although, in reality, the four developing devices 3 for Y, M, C, and Bk colors, one for one, became the same in the grid potential value and development bias potential value.

Figure 20:
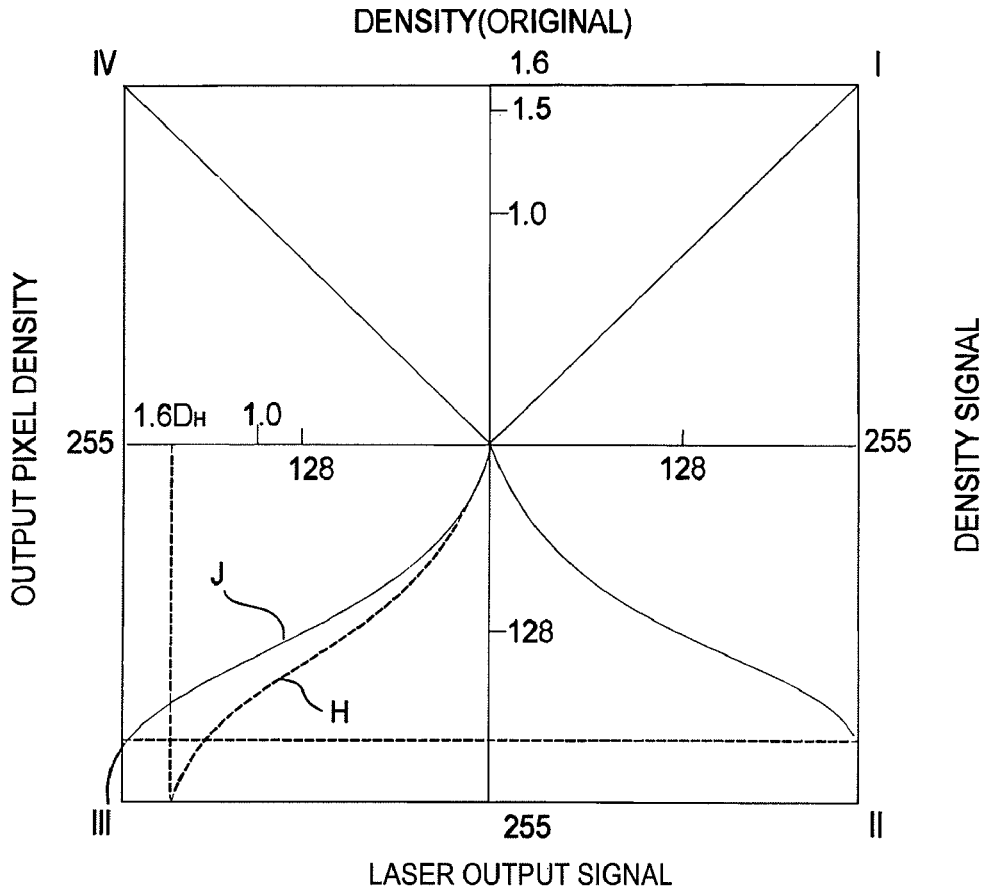
FIG. 20 is a graph showing the relationship between the laser output control signal and the density level of the corresponding picture element after the control.

FIG. 20 is a graph showing the relationship between the laser output control signal and the density level of the corresponding picture element after the control. In this embodiment, the target density value for the control was set higher than the target value for the actual highest density level. Therefore, the printer characteristic became as shown by a solid line J in the fourth quadrant of the graph in FIG. 20. If the above described control were not carried out, the printer characteristic would have become as indicated by a broken line H; it is possible that the highest density level will not reach 1.6. If the printer characteristic is as shown by the broken line H, the maximum density level cannot be raised by the LUT 25. Therefore, the density in the range between the density $D_H$ and 1.6 cannot be reproduced no matter how the LUT 25 is set. When the printer characteristic is such that its slightly exceeds the highest density level as shown by the solid line J, the density reproduction range is ensured by the correction based on the LUT 25, as indicated by the total gradation characteristic shown in fourth quadrant.

Figure 10:
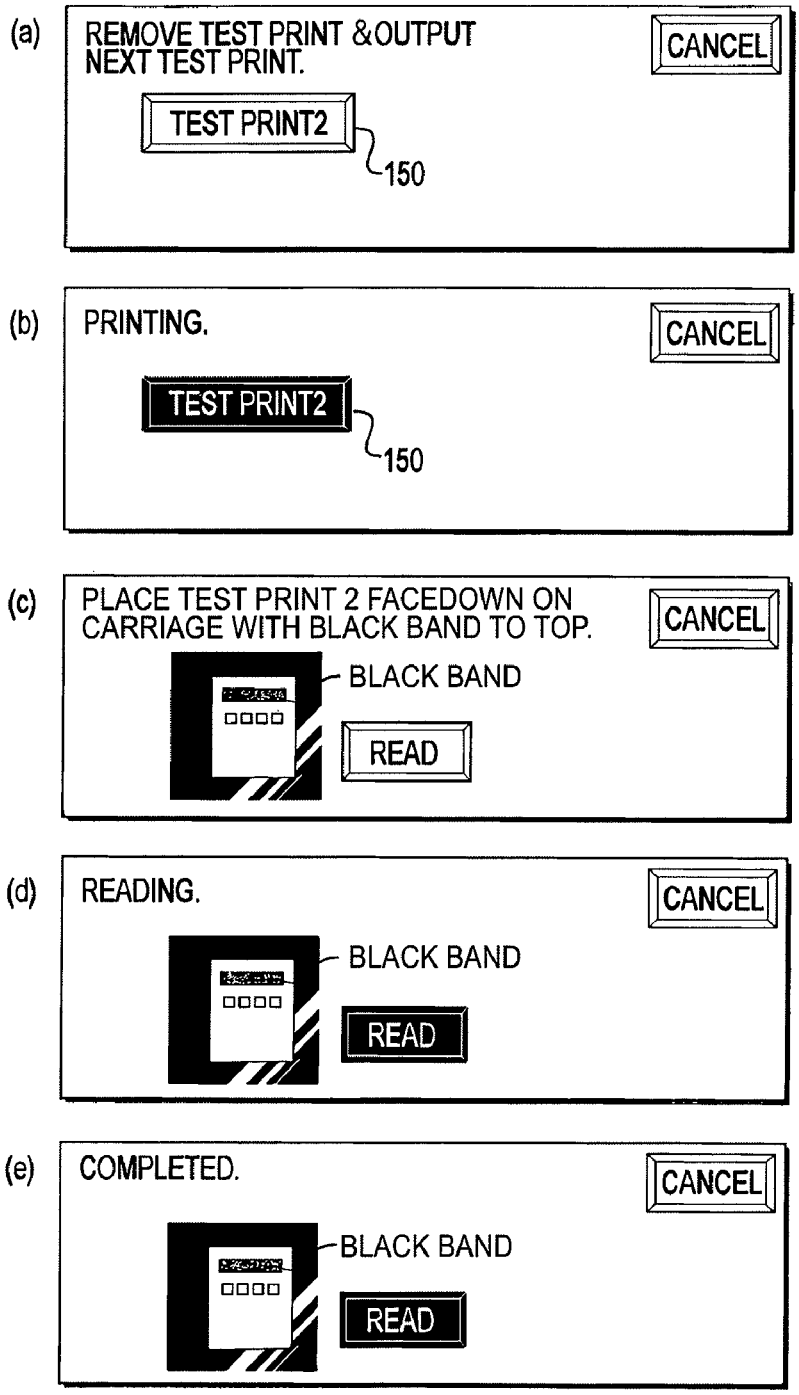
FIGS. 10(*a*), 10(*b*), 10(*c*), 10(*d*), and 10(*e*) are examples of the images displayed on the monitor screen.

Next, a printer start button 150, such as the one shown in FIG. 10(*a*), for starting the printing of the second test pattern 2 appears across the screen 218. As the operator presses the "test pattern 2" button 150, a copy of the test pattern 2 is printed out (S57). During this process, the monitor screen 218 appears as shown in FIG. 10(*b*).

Referring to FIG. 12, the test pattern 2 has two groups 71 and 72 of gradation patches. Each group has four sub-groups of gradation patches, which correspond to four colors Y, M, C, and Bk. Each sub-group of gradation patches has 64 (4×16) patches, which are different in gradation level. The 64 patches in each sub-group are primarily assigned to the lower range of the total gradation scale (having 256 levels); the number of patches assigned to the higher range is substantially smaller. This setup is for better adjusting the image processing apparatus in the reproducibility of the gradation of the highlight areas of an image.

Referring to FIG. 12, patch groups 71 and 72 are for resolutions of 200 lpi (line per inch), and 400 lpi. The resolution value at which an image is to be formed is set by designing the pulse width modulation circuit 26*a* so that the signal, which is triangular, for example, in waveform, and is used for the comparison with the picture signals to be processed, can be varied frequency.

The image processing apparatus in this embodiment forms a gradation-based image, such as a photographic image, based on the signals outputted by the above described black character decision section. If an image to be formed is a gradation-based image such as a photographic image, the image processing apparatus forms the image at 200 lpi, whereas if an image to be formed is a text or a line drawing, the image process apparatus forms the image at 400 lpi. Two copies of the same gradation level patch, may be outputted at two different resolution levels. However, when the resolution substantially affects the gradation, it is desired that the gradation test pattern, which matches the desired resolution, is outputted.

The test pattern 2 is printed using the picture signals generated by a pattern generator 29, without involving the LUT 25.

Figure 14:
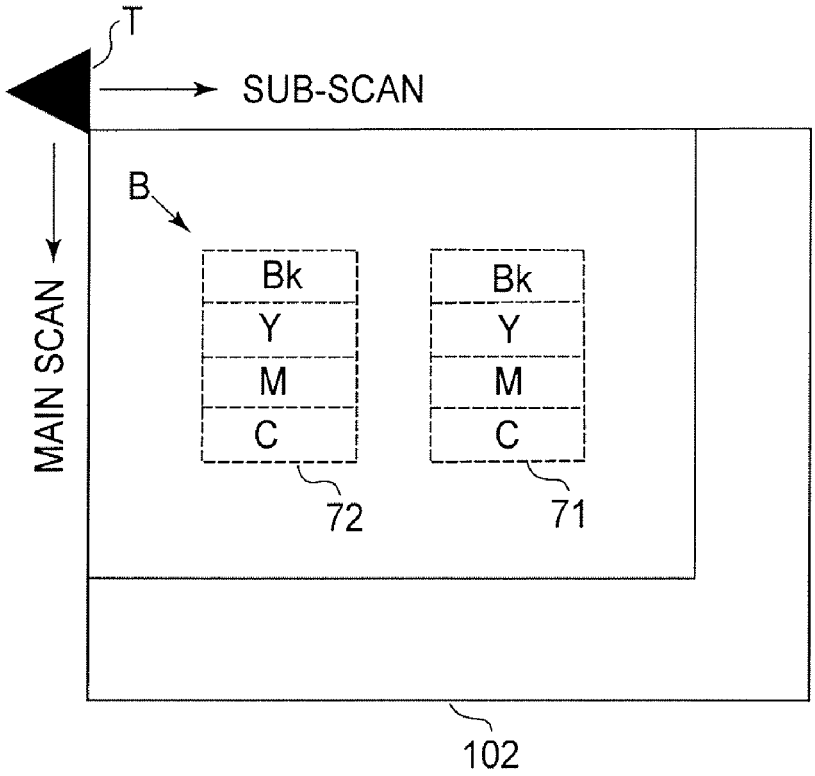
FIG. 14 is a schematic drawing showing how a copy of the test image 2 is placed on the original placement platen.

FIG. 14 is a top view of the original placement glass platen 102, on which a copy of the test pattern 2 has been properly positioned so that the corner of the copy of the test pattern 2 coincides with the tip of the referential mark T. Further, attention must be paid so that the copy of the test pattern 2 is not placed upside down. A message is displayed across the monitor screen 218 to prevent the control error attributable to the error in the positioning of the copy of the test pattern 2.

The patch groups 71 and 72 are to be sequentially read (scanned), starting from the referential mark T. As they are read, the first density gap point is obtained at the point which coincides with the corner (point B in FIG. 12) of the patch group 72. The coordinates of this density gap point B are used to calculate the relative positions of the patch groups 71 and 72 (S58). While the test pattern 2 is read, an image such as the one shown in FIG. 10(*d*) is displayed.

Figure 18:
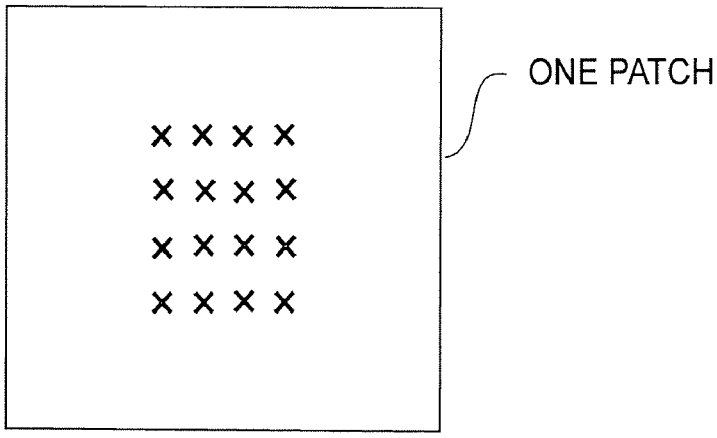
FIG. 18 is a schematic drawing showing the points of reading on a patch.

The density value of each patch (for example, patch 73 in FIG. 12) is obtained as the average value of the density levels of sixteen points of the patch selected as shown in FIG. 18. Incidentally, as for the number of points whose density levels are detected to calculate the average density level of the patch, it is desired that an optimal number is selected according to the characteristic of the reading apparatus and image forming apparatus.

Figure 19:
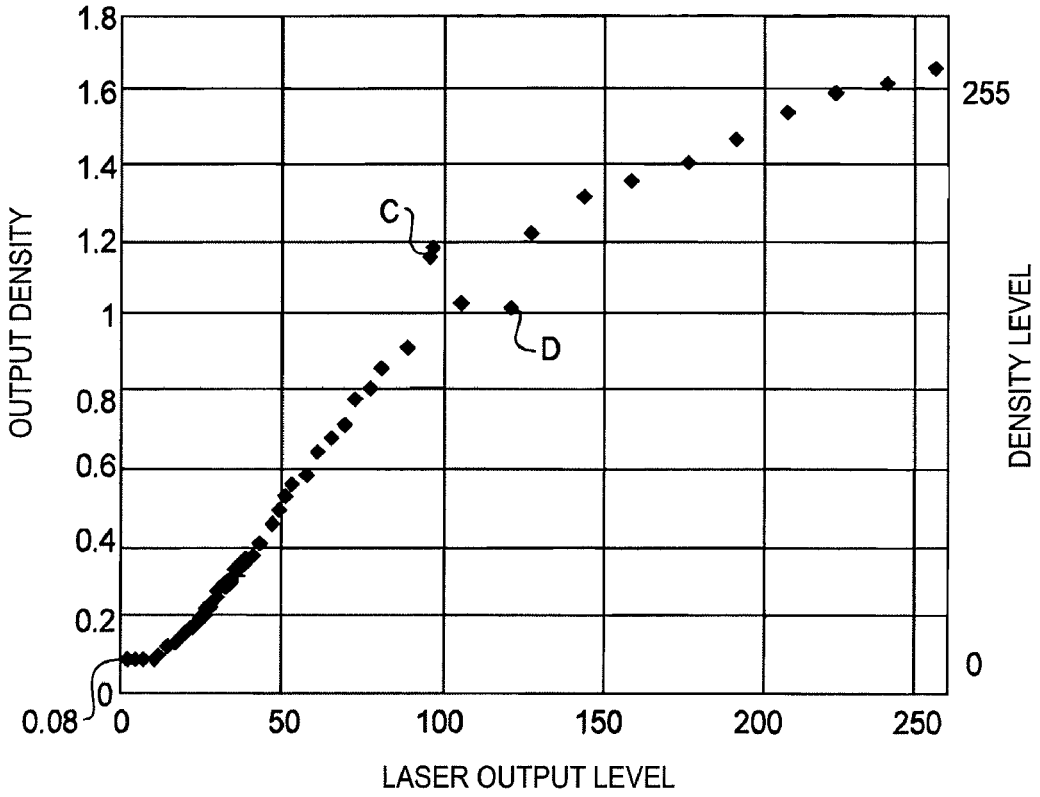
FIG. 19 is a graph showing the relationship between the density of the image (copy) of the second test image 2, and the laser output level.

FIG. 19 is a graph showing the relationship between the output density obtained by converting the RGB signals obtained from the patches, into the density values, using the above described method for converting the RGB signals into optical density levels, and the intensity of the laser output control signal (value of picture signal). The background density (0.08, for example), that is, the density level of a sheet of recording paper, is deemed as 0 level, and the highest density level, or the target density value (1.60) is deemed as 255, and the relationship is normalized.

If the density level of a given patch, which was obtained by the reading (scanning), was abnormally high, like that of the patch C shown in FIG. 19, or abnormally low, like that of the patch D shown in FIG. 19, it is possible that the original placement glass platen 102 has been soiled and/or the original test patch is defective. In such cases, data are modified for the smooth continuity of data line by limiting the inclination of data line. For example, if the inclination of data line exceeds 3, the inclination value is fixed at 3, and the datum which makes the inclination negative is replaced with the same value as that of the patch, the density of which is lower by one level.

The LUT 25 has only to be set so that its conversion characteristic becomes opposite to that shown the characteristic shown in FIG. 19 (S59). That is, all that is necessary to do is that the density level (vertical axis of FIG. 19) is switched with the input level (density signal in FIG. 6), and the laser output control signal level (horizontal axis in FIG. 19) is switched with the output level (laser output control signal in FIG. 6). The density levels which do not correspond to any patch are to be obtained by interpolation. In this step, a condition should be set so that zero in input level corresponds to zero in output level.

This concludes the contrast potential control sequence carried out by the first control system, and the creation of the gamma conversion table. As Step S59 is completed, the image on the monitor screen 219 turns into an image such as the one shown in FIG. 10(*e*).

Next, the method for controlling the image forming apparatus 1001 in terms of the glossiness level at which the apparatus output an image. The image forming apparatus 1001 has a glossiness measuring apparatus 122 (glossiness level detecting means) for measuring the glossiness level of the image which the apparatus outputs. It also has a glossiness controlling means 120 (transparent toner amount controlling means) for controlling the amount by which transparent toner is deposited, based on the glossiness level of the image, which was obtained by the glossiness measuring apparatus 122. The glossiness level of an image is determined by the amount of the transparent toner.

Next, the procedure through which the amount by which the transparent toner is to be deposited is determined by the glossiness level controlling means 120 will be described.

In this embodiment, the glossiness level controlling means 120 measures the glossiness level of an outputted image of the above described test patterns, and determines the proper amount for transparent toner, based on the output control signal for each of the monochromatic color toners (non-transparent toners) (feedback control).

The amount by which transparent toner is to be deposited is controlled to control the glossiness level at which the image forming apparatus 1001 outs an image. In this embodiment, it is controlled in order to yields an image of the test patterns, the entire surface of which is uniform in glossiness. Not only is the glossiness level, at which an image is outputted, dependent upon the amount of transparent toner, but also, the properties of the transfer medium P on which an image is formed. Therefore, the operation of the glossiness level controlling means 120 is started after the transfer mediums P to be used for an image forming operation in which the operator wants to control the glossiness level at which a copy is outputted are set in a sheet feeder section 51.

As the glossiness level controlling means 120 is started up, an image of the glossiness level control patch is outputted on the above described sheet of paper. The glossiness patches used for this operation are monochromatic density gradation patches formed of a combination of color toner (light color) and transparent toner.

Figure 21:
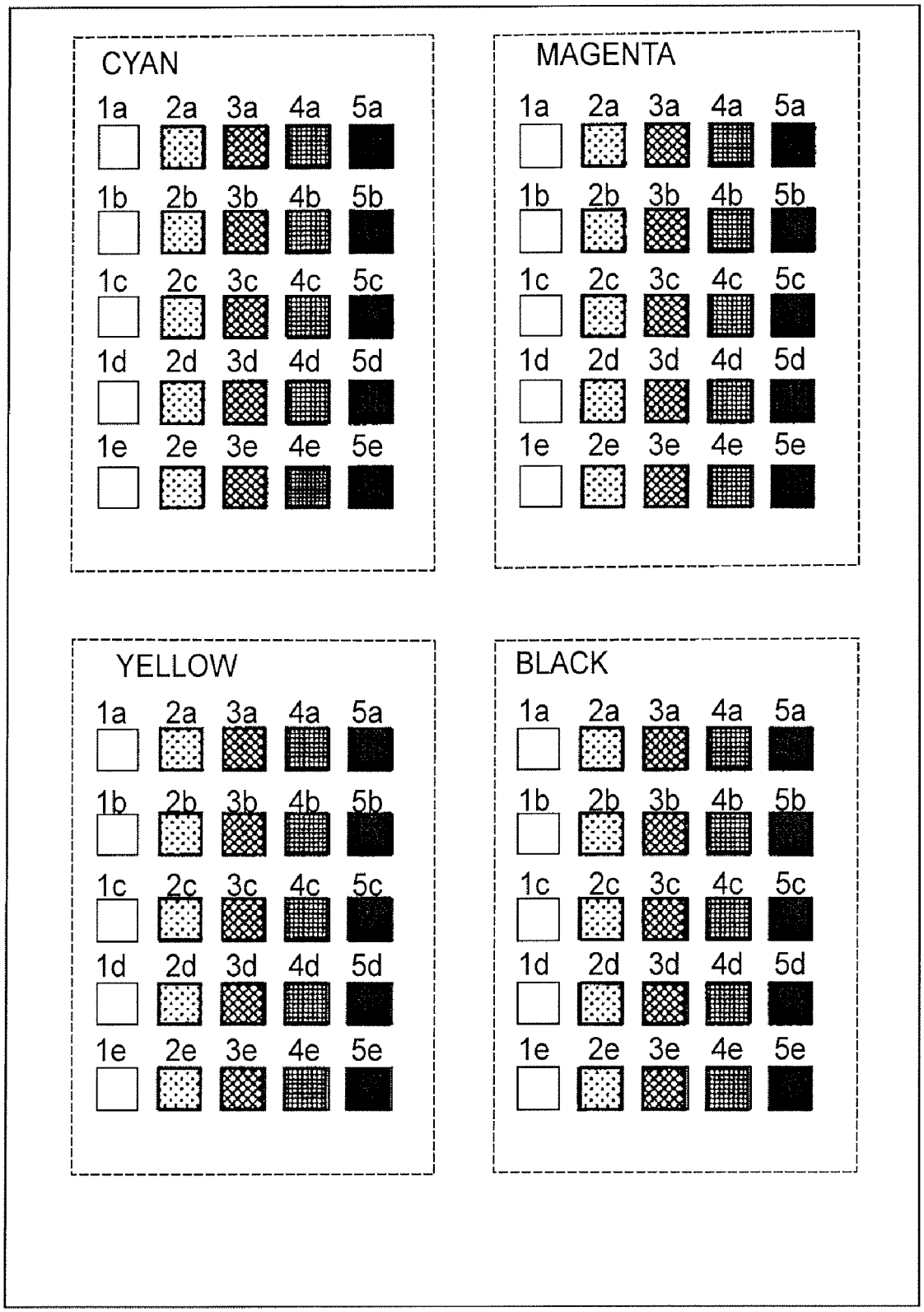
FIG. 21 is an example of the color gradation chart for glossiness control.

In this embodiment, a test pattern, such as the one shown in FIG. 21 is used. As for the image output control signal level, the value for the highest density level of the image forming apparatus in this embodiment is set to 255. Therefore, the image forming apparatus in this embodiment, which uses eight-bit picture signals, is capable of reproducing 256 levels of gradation (density levels) for each color toner (inclusive of transparent toner).

Incidentally, when creating the multiple patches different in density and arranged in the pattern shown in FIG. 21, the grid potential level and development bias potential level, which are set with the use of the above described control method are used.

The grid potential level and development bias potential level, which are used for forming a transparent toner image, are set using the following method. That is, they are set based on the relationship between the absolute amount of ambient humidity and contrast potential level, stored in advance in a table, and the output of the ambience sensor 33. The grid potential level and development bias potential level are set using the above described potential level control.

The pattern shown in FIG. 21 has four groups of density gradation patches, which correspond to four monochromatic primary colors, one for one, and each group has 25 density gradation patches different in density level (0, 64, 128, 192, and 255 density levels for monochromatic color)×5 (0, 64, 128, 192, and 255 glossiness levels for transparent toner). The top left group of density gradation patches is for the cyan toner image, and the top right group of density gradation patches is for the magenta toner image. The bottom left group of density gradation patches is for the yellow toner image, and the bottom right group of density gradation patches is for the black toner image.

That is, in each of the four groups of density gradation patches, patches 1*a*, 2*a*, 3*a*, 4*a*, and 5*a* are formed of monochromatic color toner alone (that is, cyan, magenta, yellow, or black toner), and patches 1*b*, 2*b*, 3*b*, 4*b*, and 5*b* are realized by depositing transparent toner by the amount equivalent to a density level of 64 on the patches 1*a*, 2*a*, 3*a*, 4*a*, and 5*a*, respectively. The patches 1*c*, 2*c*, 3*c*, 4*c*, and 5*c* are realized by depositing transparent toner by the amount equivalent to a density level of 128 on the patches 1*a*, 2*a*, 3*a*, 4*a*, and 5*a*, respectively, and patches 1*d*, 2*d*, 3*d*, 4*d*, and 5*d* are realized by depositing transparent toner by the amount equivalent to a density level of 192 on the patches 1*a*, 2*a*, 3*a*, 4*a*, and 5*a*, respectively. Further, patches 1*e*, 2*e*, 3*e*, 4*e* and 5*e* are realized by depositing transparent toner by the amount equivalent to a density level of 255 on the patches 1*a*, 2*a*, 3*a*, 4*a*, and 5*a*, respectively.

The "color" patches 1*a*, 1*b*, 1*c*, 1*d*, and 1*e* are 0 mg/cm$^2$ in toner amount. That is, in reality, they are patches formed of only the transparent toner; there is no color toner layer under the transparent toner layer.

The color patches 2*a*, 2*b*, 2*c*, 2*d*, and 2*e* are 0.10 mg/cm$^2$ in color toner amount. The color patches 3*a*, 3*b*, 3*c*, 3*d*, and 3*e* are 0.25 mg/cm$^2$ in color toner amount. The color patches 4*a*, 4*b*, 4*c*, 4*d*, and 4*e* are 0.35 mg/cm$^2$ in color toner amount. The color patches 5*a*, 5*b*, 5*c*, 5*d*, and 5*e* are 0.50 mg/cm$^2$ in color toner amount.

Further, the color patches 1*a*, 2*a*, 3*a*, 4*a*, and 5*a* are 0 mg/cm$^2$ in transparent toner amount. That is, in reality, the color patches 1*a*, 2*a*, 3*a*, 4*a*, and 5*a* are formed of color toner alone; they are not provided with a top layer formed of transparent toner.

The color patches 1*b*, 2*b*, 3*b*, 4*b*, and 5*b* are 0.10 mg/cm$^2$ in transparent toner amount. The color patches 1*c*, 2*c*, 3*c*, 4*c*, and 5*c* are 0.25 mg/cm$^2$ in transparent toner amount. The color patches 1*d*, 2*d*, 3*d*, 4*d*, and 5*d* are 0.35 mg/cm$^2$ in transparent toner amount. The color patches 1*e*, 2*e*, 3*e*, 4*e*, and 5*e* are 0.50 mg/cm$^2$ in transparent toner amount.

In reality, the patch 1*a* has neither a transparent toner layer nor a color toner layer.

As described above, the test pattern has the four groups of density gradation patches, that is, one for each of the four toners different in color (that is, cyan, magenta, yellow, and black toners). Further, each group of density gradation patches has the group made up of a sub-group of patches 1*a*-5*a* formed of a combination of a color toner layer and a transparent toner layer, and other sub-groups of patches (1*b*-5*b*, 1*c*-5*c*, 1*d*-5*d*, and 1*e*-5*e*). Moreover, the amount of transparent toner is adjusted so that the relationship between the amount of transparent toner and the transparent toner output control signal is linear.

A copy of the above described density gradation test pattern, which was outputted by the image forming apparatus 1001 is placed on the original placement platen 101 of the reader section A, and its glossiness is measured. Obviously, this glossiness measuring apparatus may be provided as a part of the printer section B, or may be an apparatus independent from the image forming apparatus 1001. The glossiness measuring sequence which starts with the outputting of the copy and ends in the measuring the glossiness level of the copy may be set up so that it can be manually done or may be automatically done. Incidentally, if a glossiness measuring apparatus, which is independent from the image forming apparatus 1001, is employed, a means for inputting the glossiness level values obtained by the independent glossiness measuring apparatus, into the image forming apparatus 1001, is necessary.

Next, referring to FIG. 22, the glossiness measuring apparatus 122 and glossiness measuring method used in this embodiment will be described.

The glossiness measuring apparatus 122 in this embodiment is designed to use the glossiness measuring method defined in JIS-Z8741. That is, a flux of light, which is preset in angle of divergence, is projected upon the surface of the copy of the test pattern, at a preset angle of incidence (in accordance with JIS-Z8741), and a flux of the light reflected by the surface, which is preset in angle of divergence, is measured by a light receiving device.

Figure 22:
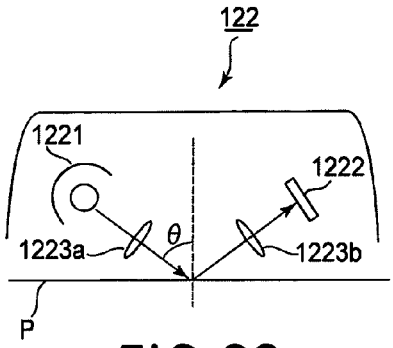
FIG. 22 is a schematic drawing of the glossiness measuring apparatus in the first embodiment of the present invention, describing the glossiness measuring method used in the first embodiment, and showing the general structure thereof.

Referring to FIG. 22, the flux of light projected from a light source 1221 transmits through a lens 1223*a*, and hits the recording medium P at an angle of θ (angle of incidence), being reflected by the surface in the same direction as that in which it would be reflected if the recording medium P were a mirror. Then, a flux of the reflected light is detected by the light receiving device 3 through a lens 1223*b*. This glossiness measuring apparatus 122 can be employed as an integral part of the reader section A or printer section B to detect the glossiness level of an image being outputted by the image forming apparatus. Incidentally, in this embodiment, the angle of incidence was set to 60° to detect the surface glossiness.

Further, when the glossiness measuring apparatus 122 is used to measure the glossiness of the copy of the glossiness control test pattern shown in FIG. 21, it is moved in a manner to oppose the pattern in which the patches are arranged.

The areas of the copy of the glossiness control pattern, the glossiness of which is measured, that is, the areas made up of the fixed color toner layer and fixed transparent toner layer laid on the fixed color toner layer, include the following areas.

That is, the first area made up of fixed layer of color toner and fixed transparent toner layer laid on the fixed layer of color toner, and the second area made up of fixed layer of color toner and fixed transparent toner layer laid on the fixed layer of color toner, and different from the first layer in the amount of toner per unit area, are detected. It is possible to make the first and second areas different in the amount of the transparent toner. Obviously, the glossiness of the area having only the transparent toner, that is, the glossiness of the area having no color toner in practical terms, can also be detected. The amount by which transparent toner is to be deposited on the recording medium can be varied based on the results of the detection.

The changes in the amount of transparent toner can be confirmed by the following method.

That is, the amount of toner (on medium) can be obtained by measuring the weight of the body of toner recovered from a preset unit area of the peripheral surface of a photosensitive member, across which toner has been adhered, with the picture signal kept constant at a preset level. It also can be obtained by measuring the weight of the body of toner recovered from a unit area of the surface of an intermediary transferring member, onto which the toner layer on the peripheral surface of the photosensitive member has been transferred, or by measuring the weight of the body of toner recovered from recording medium before the body of toner is fixed to the recording medium.

In this embodiment, when measuring only the amount of transparent toner, it can be recovered from the photosensitive drum. More concretely, toner can be exclusively recovered from various toner bearing medium, using a suctioning device fitted with a filter, the mesh size of which is no more than the toner particle diameter, and the weight of the body of toner recovered can be calculated from the difference in filter weight before and after the toner recovery.

Returning to the description of the image forming apparatus 1001 in this embodiment, the glossiness values of all the density gradation patches, which are obtained using the method described above, are sent to the glossiness controlling means 120, and are processed for the glossiness control.

Figure 23:
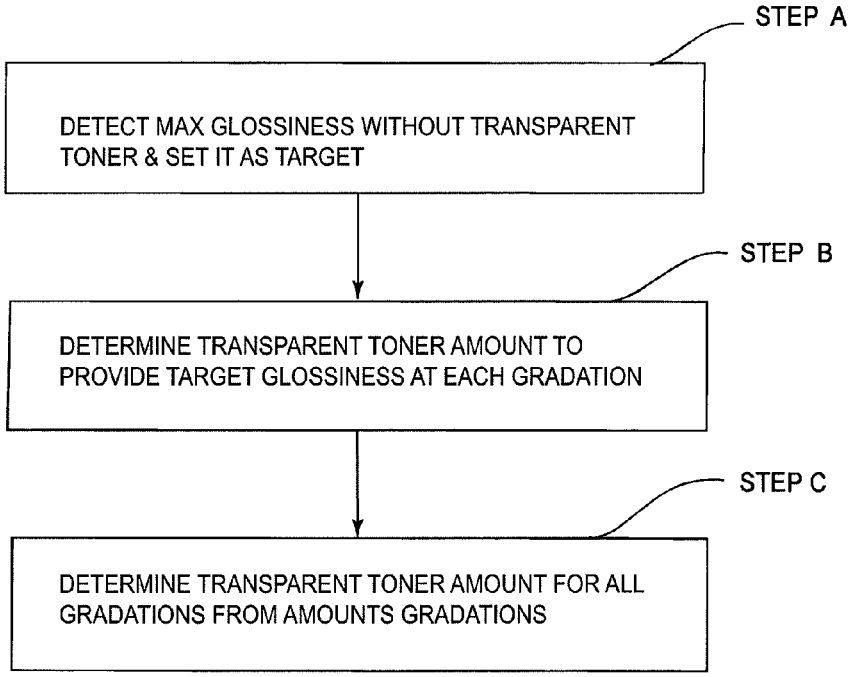
FIG. 23 is a flowchart of the process for determining the proper amount of transparent toner.

In this embodiment, the amount (transparent output control signal value) by which transparent toner is to be supplied relative to the amount by which each color toner is to be outputted is determined. The flow of the sequence for determining the amount by which transparent is to be deposited is shown in FIG. 23. In this embodiment, the glossiness control for each color toner is rendered independent from the glossiness control for the other color toners, although the sequence shown in FIG. 23 is used for all of the four colors.

Referring to the flowchart in FIG. 23, the glossiness level of the density gradation patch which is highest in gradation level is measured (Step A). In most cases, the patch which is highest in glossiness level is the patch with 0 or 255 in gradation level. Therefore, generally, the relationship between the glossiness level and density level is as shown in FIG. 24(*a*) or 24(*b*), in which the horizontal axis represents the density level, and vertical axis represents the glossiness level.

Figure 24:
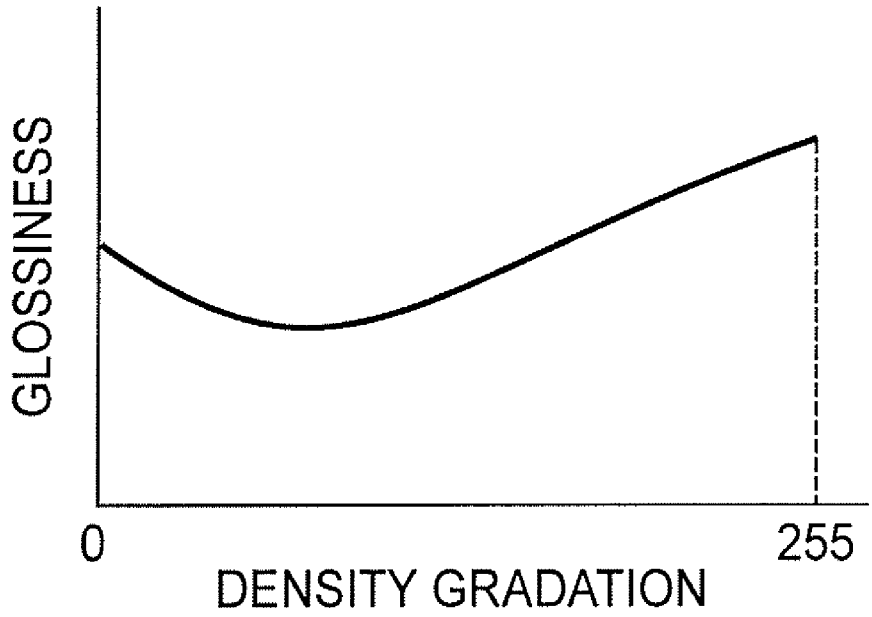
FIG. 24 is a graph showing the relationship between the glossiness and density gradation.
Figure 24:
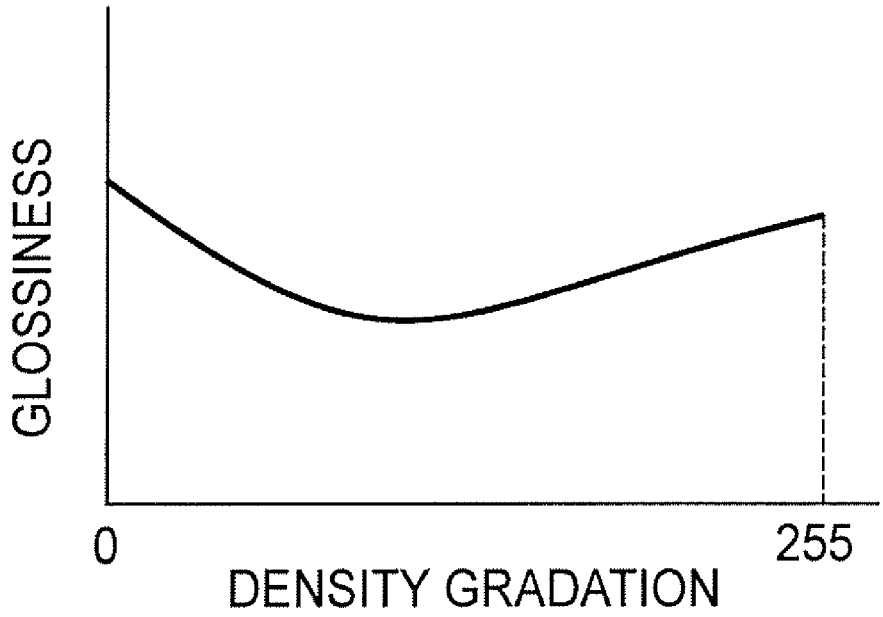

The difference between the relationships shown in FIGS. 24(*a*) and 24(*b*) comes from the relationship between the glossiness level of a sheet of paper as recording medium, and the glossiness level of the fixed toner layer. When high gloss paper (paper which is high in surface flatness) is used as recording medium, the glossiness level of the finished copy is highest where the density value is zero. On the other hand, when low gloss paper (which is lower in flatness) is used as recording medium, the glossiness level of the finished copy is highest where the density value is 255, because, as the areas of the recording medium, which are covered with a large amount of toner, is subjected to the heat from the fixing apparatus, this area becomes higher in flatness than the areas of the recording medium, which are not covered with toner. Generally, a halftone area of a copy is smaller in the amount of the toner per unit area, being therefore lower in flatness after the fixation. Therefore, a halftone area is lower in glossiness level. Thus, a larger amount of transparent toner is used for a halftone area in order to increase the halftone area in glossiness.

According to the present invention, as described above, the copy of the color chart (fixed image of the referential color chart) is measured in glossiness level. Then, the amount by which transparent toner is to be deposited per unit area of recording medium is varied based on the obtained glossiness levels of the patches formed of a fixed color toner layer and a fixed layer of transparent toner. Therefore, it is possible to achieve the glossiness of a desired level.

In this embodiment, incidentally, the combination of the transfer paper P and toners, the characteristic of which is as shown in FIG. 24(*a*) is used. The highest glossiness level was achieved where the density value was 255 (which corresponds to patches 5*a* in FIG. 21). In other words, this glossiness level is the target glossiness level for each color.

Next, in order to achieve the target glossiness level for each gradation level of each monochromatic color, the relationship between the amount by which transparent toner is to be applied, and the glossiness level achievable, is calculated from the measured glossiness level at each gradation level. (Step B)

Figure 25:
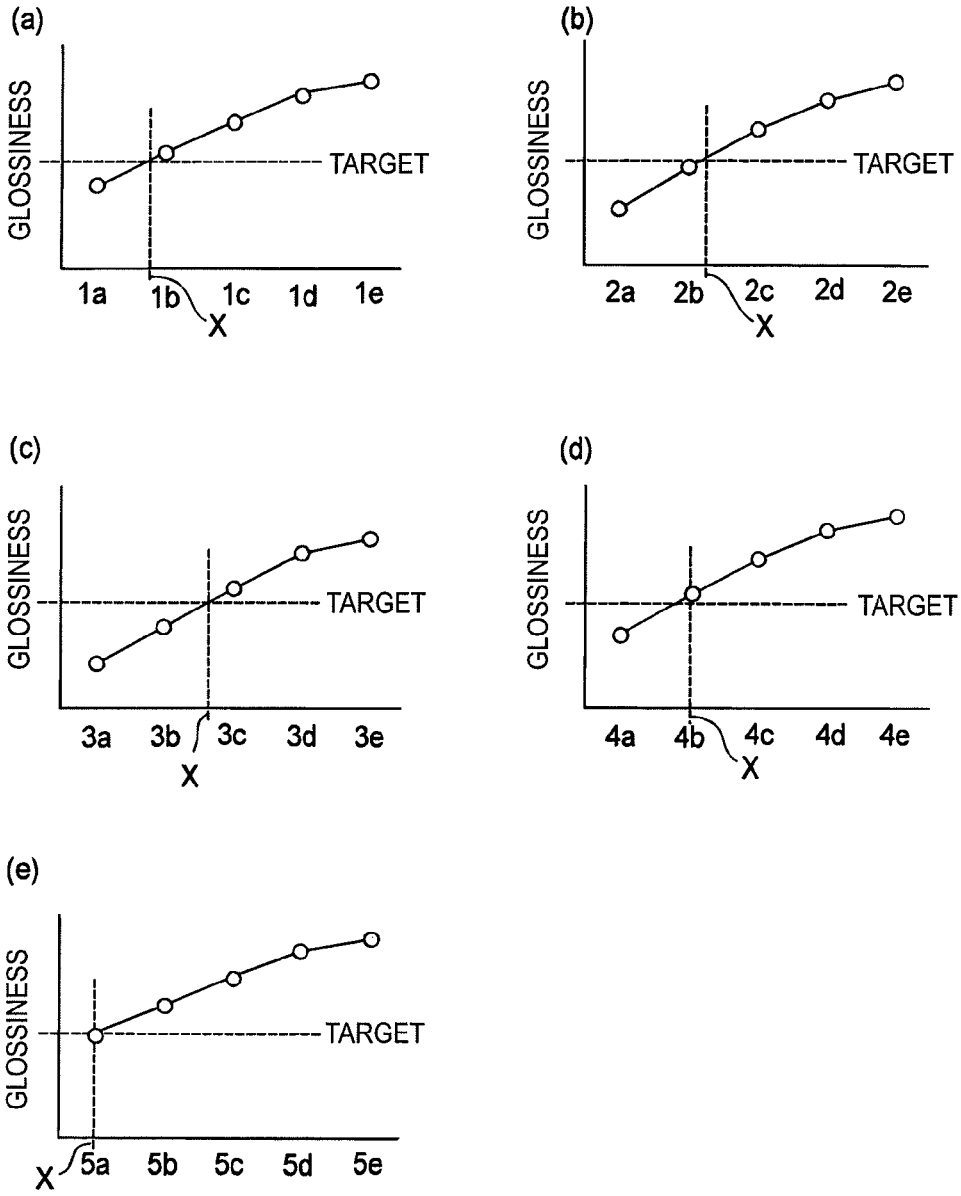
FIGS. 25(*a*)-25(*e*) are graphs showing the relationship between the density gradation and glossiness, used for determining the proper amount for transparent toner.

FIGS. 25(*a*), 25(*b*), 25(*c*), 25(*d*), and 25(*e*) show the glossiness levels which were achieved when color toner layers 1*a*, 2*b*, 3*a*, 4*a*, and 5*a* (cyan toner layers, for example), the density level of which are 0, 64, 128, 192, and 255, respectively, are coated with transparent toner layer, the density level of which is 64.

The glossiness values (data) between the glossiness values of the adjacent two patches are calculated by interpolation. In this embodiment, they are obtained with the use of liner interpolation. However, the interpolation method does not need to be limited to the linear interpolation; an optimal interpolation method may be used according to the characteristic of an image forming apparatus and the number of patches, the glossiness level of which is measured.

In FIGS. 25(*a*)-25(*e*), which correspond to various density levels, one for one, for each color toner (for example, cyan), X corresponds to the amount by which transparent toner is to be applied to achieve the target level of glossiness (which in this embodiment is the highest level of glossiness); the amount of transparent toner necessary to achieve the target level of glossiness can be calculated for each level of density gradation for each color (cyan). The amounts of transparent toner necessary to achieve the target level of glossiness for other color toners, that is, magenta, yellow, black toners, can be similarly calculated.

Next, from the amount of transparent toner necessary to achieve the target level of glossiness, which corresponds to each image output signal, the amount of transparent toner necessary to achieve the target level of glossiness is obtained by interpolation, for the entire picture signal range of this color (Step C).

Figure 26:
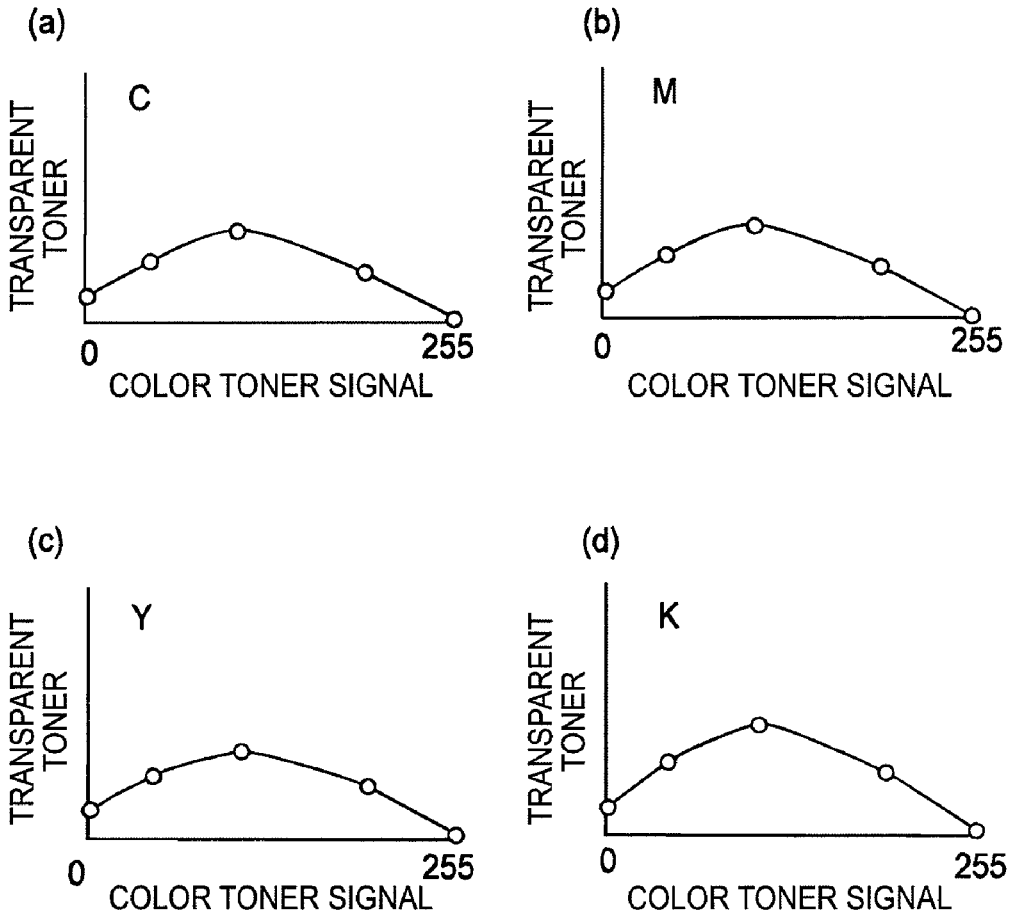
FIGS. 26(*a*)-26(*d*) are graphs showing the relationships between the picture signals for the four color toners (non-transparent) and the proper amount for transparent toner.

The interpolation method used for this step is the same as that used to calculate the amount of transparent toner necessary for achieving the target level of glossiness for each level of density gradation. In this step, however, the smoothing process is used to smooth the change in glossiness between the different levels of gradation (FIG. 26). FIG. 26 shows the amounts of transparent toner, which were obtained for the four color toners, using the same calculation, in the above-mentioned Step B.

That is, FIGS. 26(*a*)-26(*d*) are graphs made by plotting the amount (picture signal level for transparent toner) of transparent toner necessary to achieve the target level of glossiness, for each of the four groups of color patches different in density level, interpolating data interval, and smoothing the data. FIG. 26(*a*) shows the relationship between the amount of transparent toner and the picture signal value for cyan toner, across the entire signal range. Similarly, FIGS. 26(*b*), 26(*c*), and 26(*d*) show the relationship between the amount of transparent toner and the picture signal value for magenta, yellow, and black toners, respectively, across the entire picture signal ranges.

Figure 27:
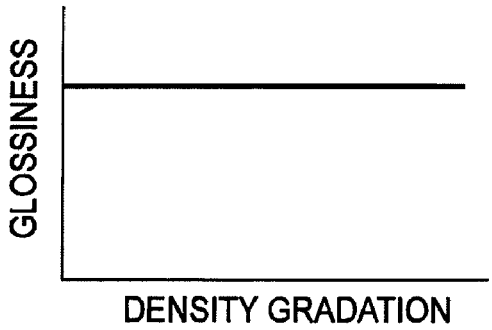
FIG. 27 is a graph showing the relationship between the glossiness and density gradation after the glossiness control.

When the picture signals for the transparent toner, which are obtained using the above described method are used to form a copy of a monochromatic image using a color toner and a transparent toner, the resultant image is uniform in glossiness, across the entire density gradation range, as shown in FIG. 27.

As described above, the same calculation is made for the four color toners, to determine the picture signal values for the transparent toner, which correspond to the picture signal values for each color toners. This concludes the glossiness level control. Then, the operation for actually forming intended images is started.

When an intended image is outputted, the sum of the value of the transparent toner output control signal, which corresponds to the value of the cyan toner output control signal, the value of the transparent toner output control signal, which corresponds to the value of the magenta toner output control signal, the value of the transparent toner output control signal which corresponds to the value of the magenta toner output control signal, and the value of the transparent toner output control signal, which corresponds to the value of the black toner output control signal, is used as the value for the transfer toner output signal.

For example, it is assumed that the cyan, magenta, yellow, and black toner output control signal levels are 40, 80, 20, and 40, respectively. Further, the transparent toner output control signal levels, which correspond to the cyan, magenta, yellow, and black toner output control signal levels 40, 80, 20, and 40, respectively, are 30, 20, 10, and 20, respectively. In this case, the level at which the transparent toner output control signal must be is 80 (=30+20+10+20). Thus, an image is formed with the cyan, magenta, yellow, and black output control signal levels set at 40, 80, 20, and 40, respectively, whereas, the transparent toner output control signal level set at 80.

Therefore, even if the image forming apparatus 1001 changes in characteristic, it can form an image which is entirely uniform in glossiness, that is, an image, which is uniform in glossiness level across its density gradation range.

In this embodiment of the present invention, the four monochromatic toner images, different in color, formed by the image forming apparatus 1001 are the same in glossiness level; their glossiness is highest in the glossiness scale, that is, their glossiness is at the target level. In this embodiment, the toner output control signal level of 255 corresponds to the highest glossiness level, regardless of color.

Thus, the four monochromatic toner images, different in color, are the same in glossiness level regardless of density gradation level. Therefore, a single multicolor image formed by placing the four monochromatic images different in color, is the same in glossiness level as each of the monochromatic images, regardless of the glossiness levels of the four monochromatic images.

For example, the glossiness level of a monochromatic cyan image, which corresponds to a signal value of 255, is the same as that of a monochromatic cyan image, which corresponds to a signal value of 32, and the glossiness level of a monochromatic magenta image, which corresponds to a signal value of 255, is the same as that of a monochromatic magenta image, which corresponds to a signal value of 32. Therefore, even if a monochromatic cyan image, which corresponds to a signal value of 255 and a monochromatic magenta image, which corresponds to signal value of 255, are different in glossiness level, an image formed by layering a monochromatic cyan image, the density level of which corresponds to a signal level of 255 and a monochromatic magenta image, the density level of which corresponds to a signal level of 255, and an image formed by layering a monochromatic cyan image, the density level of which corresponds to a signal level of 255 and a monochromatic magenta image, the density level of which corresponds to a signal level of 32, are the same in glossiness, and so is a compound image formed by layering a monochromatic cyan image, the density level of which corresponds to a signal level of 32 and a monochromatic magenta image, the density level of which corresponds to a signal level of 32.

That is, according to the present invention, it is important that all monochromatic images of the same color are the same in glossiness, and even if multiple monochromatic toner images different in color, which are layered to form a single compound toner image, are different in glossiness, the sum of the values of the glossiness of each monochromatic toner image remains constant. Therefore, the image forming apparatus in accordance with the present invention can form an image, which is uniform in glossiness, across the entire range of the gradation scale.

Further, the value for a transparent toner output control signal, which is obtained through the glossiness control carried out by the glossiness controlling means 120, is stored in the storage means 121 (memory). Needless to say, two or more values for a transparent toner output control signal can be stored in the storage means 121. Therefore, a use can access an optimal value for the recording paper used for an intended image forming operation.

The frequency at which the glossiness control is carried out by the above described glossiness controlling means 120 may be optional. That is, the glossiness control may be carried out once for every preset number of copies, for example, an optional number of copies, within a range of 1,000-5,000 copies, or once for every preset length of time, for example, once for an optional length of time within a range of one to two months.

Embodiment 2

In the first embodiment described above, the image forming apparatus was designed so that a toner image formed on the photosensitive drum 4 is directly transferred onto the recording medium P borne on the transfer drum 5. However, the present invention is also applicable to an image forming apparatus designed so that multiple monochromatic color toner images, different in color, and a transparent toner image, are formed in layers on the photosensitive drum 4, and then, are directly transferred onto recording medium, as it is to the image forming apparatus in the first embodiment. This embodiment also can achieve the same beneficial effects as those achieved by the first embodiment.

Figure 28:
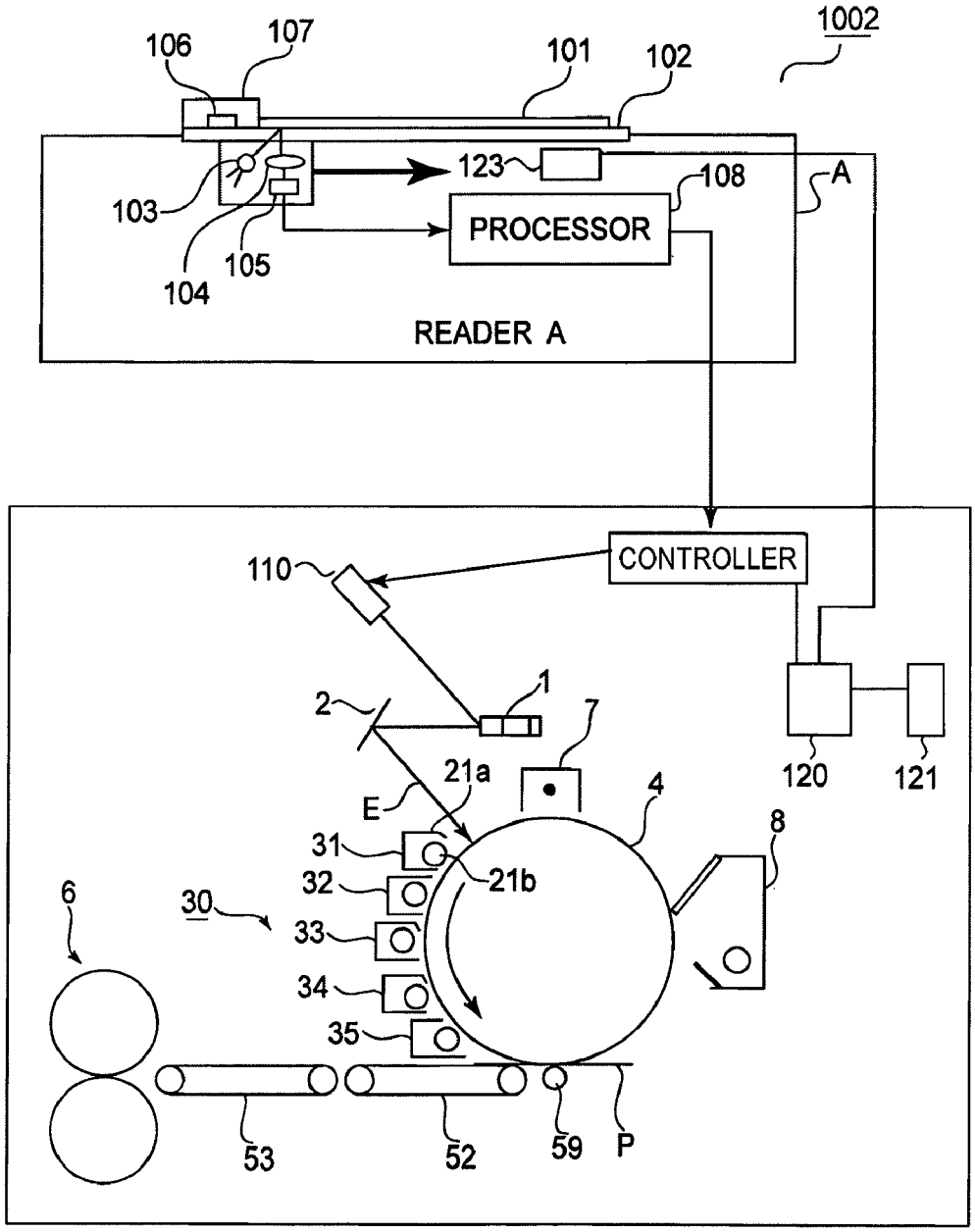
FIG. 28 is a schematic drawing of the image forming apparatus in another embodiment of the present invention, showing the general structure of the image forming apparatus.

FIG. 28 shows an example of such an image forming apparatus. Like the image forming apparatus in the first embodiment, the image forming apparatus 1002 shown in FIG. 28 is made up of a reader section A and printer section B. The reader section A of the image forming apparatus 1002 is the same in structure as the reader section A of the image forming apparatus 1001 in the first embodiment, and therefore, will not be described.

Next, the printer section B of the image forming apparatus 1002 in this embodiment will be briefly described. The components of the printer section B of the image forming apparatus 1002, which are the same in structure and function as those of the image forming apparatus 1001 in this first embodiment described above, are given the same referential symbols as those given to the counterparts in the first embodiments, and will not be described in detail.

The image forming apparatus 1002 shown in FIG. 28 has an electrophotographic photosensitive member, as an image bearing member, in the form of a drum, that is, a photosensitive drum 4. In the adjacencies of the peripheral surface of the photosensitive drum 4, a charging device 7 as a charging means, a laser light source 110 as an exposing means, a polygon mirror 1 which reflects the beam of laser light E projected from the laser light source 110, a mirror 2, a cleaner 8 as a cleaning means, multiple developing devices 31, 32, 33, 34, and 35, which make up a developing apparatus 3, are disposed.

Each of the developing devices 31, 32, 33, 34, and 35 is disposed so that its peripheral surface opposes the peripheral surface of the photosensitive drum 4. In this embodiment, the developing devices 31, 32, 33, 34, and 35 are developing devices for yellow, magenta, cyan, black, and transparent toners, respectively.

The image forming operation of this image forming apparatus 1002, for example, the full-color forming operation, is as follows: First, the peripheral surface of the photosensitive drum 4 is charged by the charging device 7. Then, the beam of laser light E is projected onto the charged peripheral surface of the photosensitive drum 4, while being modulated with the picture signals sent to the image forming apparatus 1002 from the reader section A for reading an original, or a personal computer or the like connected to the image forming apparatus 1002. As a result, an electrostatic image (latent image) is formed on the peripheral surface of the photosensitive drum 4.

Then, one of the developing devices, for example, the developing device 3, which corresponds in color to this latent image, is activated. As a result, a visible image (image formed of developer (toner) is formed on the peripheral surface of the photosensitive drum 4.

As the operation described above is repeated, a yellow toner layer (image), a magenta toner layer (image), a cyan toner layer (image), a black toner layer (image), and a transparent toner layer (image) are sequentially formed in layers on the peripheral surface of the photosensitive drum 4. As a result, a single multilayer toner image is effected on the peripheral surface of the photosensitive drum 4.

Thereafter, the multilayer toner image on the photosensitive drum 4 is transferred onto a recording medium P, by the function of the transfer bias applied to a transfer roller 51 (transferring means), in the area (transfer area) in which the photosensitive drum 4 and transfer roller 51 oppose each other. The recording medium P is delivered to the transfer area from an unshown recording medium feeder section, in synchronism with the arrival of the leading edge of the multilayer toner image on the photosensitive drum 4 at the transfer area.

After the transfer of the toner image onto the recording medium P, the recording medium P is conveyed by conveyer belts 52 and 53 to a fixing device 6 as a fixing means of the roller type, in which the recording medium P is subjected to heat and pressure. As a result, the toner image is fixed, as a permanent image, to the recording medium P. Thereafter, the recording medium P is discharged from the main assembly of the image forming apparatus 1002.

The transfer residual toner, that is, the toner remaining on the peripheral surface of the photosensitive drum 4 after the transfer process, is removed by the cleaner 8.

The image forming apparatus in this embodiment also is provided with a glossiness controlling means 120, a storage means 121, etc., as is the image forming apparatus in the first embodiment. Thus, it also can control the amount by which transparent toner is applied, as can the image forming apparatus in the first embodiment, during an image forming operation. Therefore, it can form an image which is entirely uniform in glossiness, across the entire range of gradation scale.

Embodiment 3

In the first embodiment described above, the image forming apparatus was designed to transfer a toner image formed on the photosensitive drum 4, onto the recording medium P borne on the transfer drum 5. Further, in the second embodiment, the image forming apparatus was designed to transfer a multilayer toner image formed on the photosensitive drum 4, onto the recording medium P. However, the present invention is also applicable to an image forming apparatus of the so-called intermediary transfer type, that is, an image forming apparatus in which a toner image formed on the photosensitive drum 4 is temporarily transferred onto an intermediary transferring member as the second image bearing member, and then, is transferred from the intermediary transferring member, onto the recording medium P. That is, an image forming apparatus of the intermediary transfer type can also benefit from the present invention as can the image forming apparatus in the first and second embodiments. Further, the number of the color toners, and the number of the toner colors, do not need to be limited to the four mentioned in the description of the first and second embodiments. The third embodiment of the present invention also can achieve the same beneficial effects as those achieved by the first and second embodiments.

Figure 29:
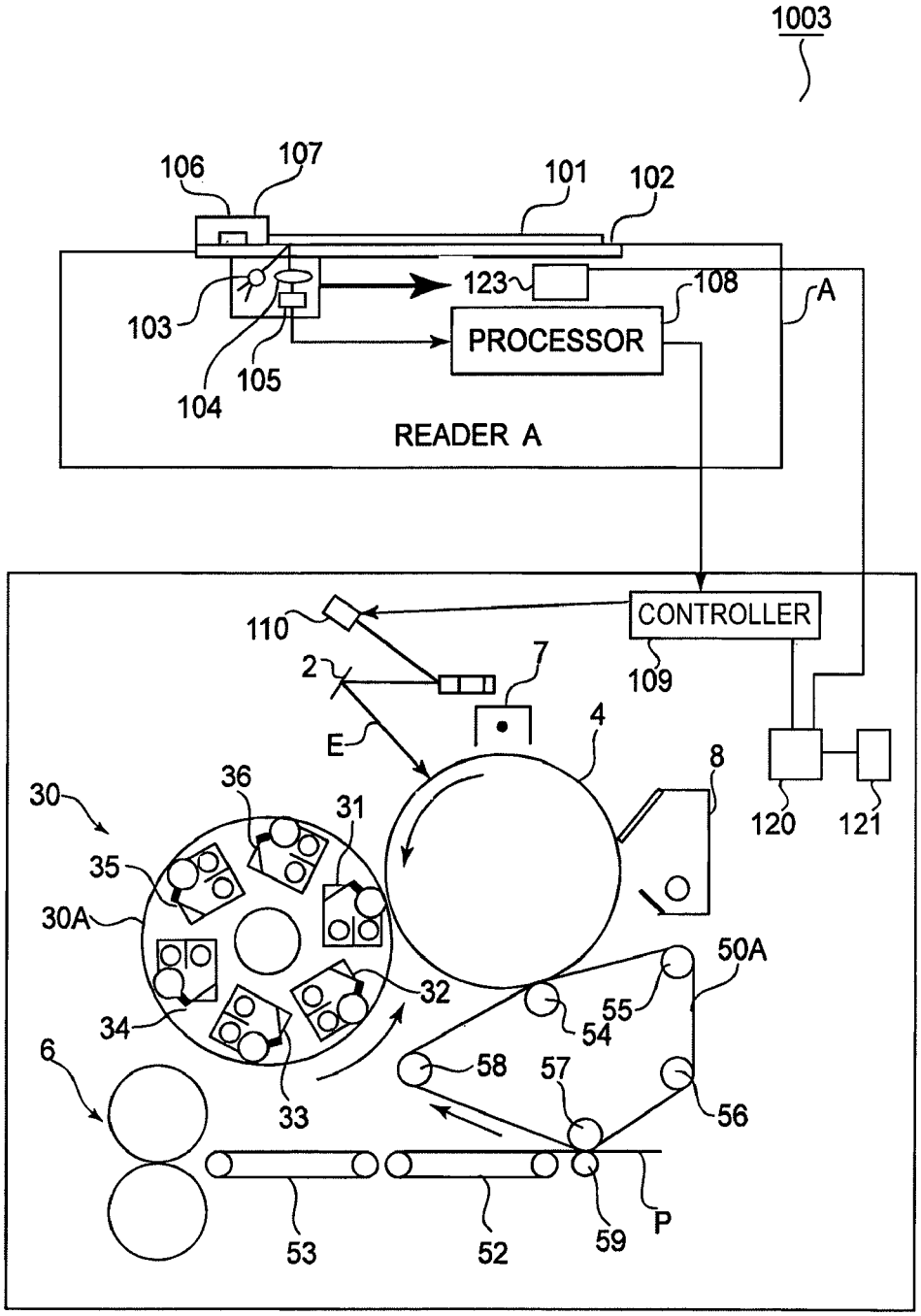
FIG. 29 is a schematic drawing of the image forming apparatus in yet another embodiment of the present invention, showing the general structure of the image forming apparatus.

FIG. 29 shows an example of an image forming apparatus of the intermediary transfer type. Next, the image forming apparatus in this embodiment will be briefly described.

The image forming apparatus 1003 shown in FIG. 29 also is made up of the reader section A and printer section B. The reader section A of the image forming apparatus 1003 is the same in structure as the reader section A of the image forming apparatus 1001 in the first embodiment, and therefore, will not be described.

The printer section B of the image forming apparatus 1003 has an electrophotographic photosensitive member, as an image bearing member, in the form of a drum, that is, a photosensitive drum 4. In the adjacencies of the peripheral surface of the photosensitive drum 4, a charging device 7 as a charging means, a laser light source 110 as an exposing means, a polygon mirror 1 which reflects the beam of laser light E projected from the laser light source 110, a mirror 2, a cleaner 8 as a cleaning means, and a developing devices 30 of the rotary type. Further, the printer section B is provided with an intermediary transfer belt 50A, which is stretched around rollers 55, 56, 57, and 58, being thereby suspended by the rollers, in a manner to oppose the peripheral surface of the photosensitive drum 4. The intermediary transfer belt 50A, which is an intermediary transferring member, serves as the second image bearing member.

The developing apparatus 30 of the rotary type has a development rotary 30A, that is, a member which is rotatably supported in a manner to oppose the peripheral surface of the photosensitive drum 4. In the development rotary 30A, five color developing devices 31, 32, 33, 34, and 35, as developing means, which contain yellow, magenta, cyan, black, and light black toners, respectively, and a glossiness control developing device 36, which contains transparent toner, are disposed.

The image forming operation of this image forming apparatus 1003, for example, the full-color forming operation, is as follows: First, the peripheral surface of the photosensitive drum 4 is charged by the charging device 7. Then, the beam of laser light E is projected onto the charged peripheral surface of the photosensitive drum 4, while being modulated with the picture signals sent to the image forming apparatus 1003 from the reader section A for reading an original, or a personal computer or the like connected to the image forming apparatus 1003. As a result, an electrostatic image (latent image) is formed on the peripheral surface of the photosensitive drum 4. This latent image is developed by the developing apparatus 30 of the rotary type. That is, the development rotary 30A is rotated in the direction indicated by an arrow mark to move the developing device 31, for example, to development area, in which the developing device 31 opposes the peripheral surface of the photosensitive drum 4. Then, the developing device 31 is activated. As a result, a visible image (image formed of developer (toner) is formed on the peripheral surface of the photosensitive drum 4.

Then, the toner image on the photosensitive drum 4 is transferred onto the intermediary transfer belt 50A, by the function of the primary transfer bias applied to the primary transfer roller 54 as the primary transferring means, in the area (primary transfer area) in which the photosensitive drum 4 and intermediary transfer belt 50A oppose each other.

As the operation described above is repeated, a yellow toner layer (image), a magenta toner layer (image), a cyan toner layer (image), a black toner layer (image), a light black toner layer (image), and a transparent toner layer (image) are sequentially deposited in layers on the intermediary transfer belt 50A. As a result, a single multilayer toner image is effected on the peripheral surface of the photosensitive drum 4.

Thereafter, the multilayer toner image on the intermediary transfer belt 50A is transferred onto a recording medium P, by the function of the secondary transfer bias applied to a secondary transfer roller 59 as the secondary transferring means, in the area (secondary transfer area) in which the secondary transfer roller 59 and intermediary transfer belt 50A oppose each other. The recording medium P is delivered to the secondary transfer area from an unshown recording medium feeder section, in synchronism with the arrival of the leading edge of the multilayer toner image on the intermediary transfer belt 50A at the secondary transfer area.

After the transfer of the toner image onto the recording medium P, the recording medium P is conveyed by conveyer belts 52 and 53 to a fixing device 6 as a fixing means of the roller type, in which the recording medium P is subjected to heat and pressure. As a result, the toner image is fixed, as a permanent image, to the recording medium P. Thereafter, the recording medium P is discharged from the main assembly of the image forming apparatus 1003.

The primary transfer residual toner, that is, the toner remaining on the peripheral surface of the photosensitive drum 4 after the primary transfer process, is removed by the cleaner 8. Further, the secondary transfer residual toner, that is, the toner remaining on the intermediary transfer belt 50A after the secondary transfer process, is removed by an unshown transfer belt cleaner.

The image forming apparatus in this embodiment also is provided with a glossiness controlling means 120, a storage means 121, etc., as are the image forming apparatuses in the first and second embodiments. Thus, it also can control the amount by which transparent toner is applied, as can the image forming apparatuses in the first and embodiments, during an image forming operation. Therefore, it can yield a copy of a multicolor original, which is uniform in glossiness across the entirety, that is, various areas of copy, which are different in color (Y, M, C, Bk, and mixtures thereof), and across the entirety of gradation scale.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 352617/2005 filed Dec. 6, 2005, which is hereby incorporated by reference.

What is claimed is:

1. An image forming apparatus comprising:

toner image forming means for forming a non-transparent toner image and a transparent toner image on a recording material;

fixing means for fixing the non-transparent toner image and the transparent toner image formed by said toner image forming means on the recording material;

glossiness detecting means for detecting a glossiness of a surface of a recording material to be detected, said glossiness detecting means including a light source and a light receiving portion for receiving light which is projected from said light source and is specularly reflected by the surface of the recording material to be detected;

correcting means for correcting an image forming condition of said toner image forming means to correct an amount of transparent toner per unit area to be formed on a recording material on the basis of a result of detection, by said glossiness detecting means, of a predetermined region on the surface of the recording material to be detected where non-transparent toner and transparent toner are overlaid;

storing means for storing information corresponding to the corrected image forming condition of said toner image forming means; and control means for controlling said toner image forming means according to the corrected image forming condition to form a transparent toner image on a recording material on the basis of the information stored in said storing means.

2. An apparatus according to claim 1, wherein said glossiness detecting means detects the glossiness of different toner images, which are different in the amount of the transparent toner per unit area, on the surface of the recording material to be detected.

3. An apparatus according to claim 2, wherein said glossiness detecting means detects the glossiness of different toner images, which are different in the amount of the non-transparent toner per unit area, on the surface of the recording material to be detected.

4. An apparatus according to claim 1, wherein the predetermined region includes a region where a predetermined amount of non-transparent toner and a predetermined amount of transparent toner are overlaid.

5. An apparatus according to claim 1, wherein the predetermined region includes a plurality of patches, each patch formed by overlaying a predetermined amount of non-transparent toner and a predetermined amount of transparent toner.

6. An apparatus according to claim 5, wherein the detection, by said glossiness detecting means, of the predetermined region comprises detection, by said glossiness detecting means, of each of the plurality of patches.

7. An apparatus according to claim 1, wherein said control means controls said toner image forming means to form a transparent toner image on a subsequent recording material on the basis of the stored information.

* * * * *